United States Patent [19]

Sullivan et al.

[11] Patent Number: 4,648,358

[45] Date of Patent: Mar. 10, 1987

[54] ROTARY VEE ENGINE

[75] Inventors: Robert W. Sullivan, Snyder; Tommie J. Holder, Mountain Park; Max F. Buchanan, Roosevelt, all of Okla.

[73] Assignee: Sullivan Engine Works, Inc., Snyder, Okla.

[21] Appl. No.: 757,270

[22] Filed: Jul. 22, 1985

[51] Int. Cl.[4] ..... F02B 57/06

[52] U.S. Cl. ..... 123/43 A; 91/500

[58] Field of Search ..... 91/500; 123/43 A, 43 AA, 123/65 BA, 65 UC

[56] References Cited

U.S. PATENT DOCUMENTS

| | | | |
|---|---|---|---|
| 1,219,377 | 3/1917 | Davidson . | |
| 1,389,873 | 9/1921 | Hult . | |
| 1,697,853 | 1/1929 | Coursen . | |
| 1,779,032 | 10/1930 | Cathcart . | |
| 1,886,492 | 11/1932 | Mattson . | |
| 1,972,335 | 9/1934 | Gardner | 123/43 |
| 1,986,584 | 1/1935 | Koplar | 91/500 X |
| 2,117,521 | 5/1938 | Stevens | 91/500 |
| 2,312,417 | 3/1943 | Jones | 91/500 |
| 2,444,764 | 7/1948 | Baker | 123/43 |
| 2,512,265 | 6/1950 | Brigaudet | 123/43 |
| 2,543,134 | 2/1951 | Smith et al. | 91/500 X |
| 2,923,245 | 2/1960 | Aspelin | 91/500 X |
| 3,007,513 | 11/1961 | Aspelin | 91/500 X |
| 3,830,208 | 8/1974 | Turner | 123/43 A |
| 3,902,468 | 9/1975 | Turner | 123/43 A |
| 3,905,338 | 9/1975 | Turner | 123/43 A |
| 3,973,531 | 8/1976 | Turner | 123/43 A |
| 4,060,060 | 11/1977 | Turner | 123/43 A |

FOREIGN PATENT DOCUMENTS

| | | | |
|---|---|---|---|
| 18241 | of 1912 | United Kingdom | 123/43 A |
| 453894 | 10/1936 | United Kingdom . | |
| 1245323 | 9/1971 | United Kingdom . | |

OTHER PUBLICATIONS

"Say, Smokey", Popular Science, Dec. 1971, pp. 48–49.

"Unbelievable—But We've Seen it Work", *Popular Science,* Aug. 1974, pp. 62–64, 117.

*Primary Examiner*—Michael Koczo

*Attorney, Agent, or Firm*—Dunlap, Codding & Peterson

[57] ABSTRACT

An internal combustion engine having two rotating cylinder blocks in each of which is formed a plurality of cylinders to receive portions of pistons that extend partially into each cylinder block. The cylinder blocks are angled relative to one another and the pistons are similarly angled to cause variation in the free volumes of the cylinders as the cylinder blocks rotate. A support shaft passes through the centers of the cylinder blocks to provide support for the cylinder blocks via bearings on the support shaft. Air is introduced into the cylinders via central cavities in the cylinder blocks and fins and slots are formed on, and in, respectively, the interior walls of the cavities to impart rotation to air in the cavities. A series of rings, through which the cylinders pass, are formed on the end of each cylinder block that faces away from the other cylinder block to circulate cooling air drawn into a housing in which the blocks are mounted about the cylinders. The air is drawn into openings through the housing positioned axially of each cylinder block and discharged through apertures through the housing positioned radially of each series of rings.

18 Claims, 16 Drawing Figures

ROTARY VEE ENGINE

BACKGROUND OF THE INVENTION

1. Field of the Invention

The present invention relates to improvements in internal combustion engines and, more particularly, to internal combustion engines of the rotary vee type.

2. Brief Description of the Prior Art

In a conventional internal combustion engine, pistons reciprocate in cylinders formed in a stationary cylinder block and combustion within the cylinders is timed to cause the pistons to turn a crank shaft from which power is delivered from the engine. While engines of this type are the most common type of engine currently in use, it has been recognized that such engines are inherently subject to a problem that lowers the efficiency of the engine. In particular, the reciprocation of the piston involves a sequence of accelerations of each piston from rest followed by a deceleration of each piston to rest. The work that is done on the pistons during these accelerations and decelerations is not recovered so that the energy, provided by the fuel used in the engine, necessary to perform this work results in an overall loss of efficiency of the engine.

Because of this loss of efficiency in a conventional engine, other types of engines have been considered as possible candidates for replacing the conventional engine. One such type of engine is the rotary vee engine which includes two cylinder blocks mounted in a housing for rotation about intersecting axes that are angled toward one side of the engine. Cylinders are bored into each of the cylinder blocks from the end which faces the other cylinder block and the engine is further comprised of a plurality of pistons, angled in the same manner that the rotation axes of the cylinder blocks are angled, so that one portion of each piston can be extended into a cylinder in one cylinder block and another portion of the piston can be extended into a corresponding cylinder in the other cylinder block. Thus, as the cylinder blocks rotate, the pistons orbit about the rotation axes of the cylinder blocks to vary the free volumes of the cylinders in the cylinder blocks. That is, when a piston is on the side of the engine away from which the rotation axes of the cylinder blocks are angled, only a small part of each piston will extend into each of the cylinders, in the two cylinder blocks, in which the piston is mounted while major portions of each piston are disposed in the two cylinders in the two cylinder blocks when the piston is moved to a position at the side of the engine toward which the two rotation axes of the cylinder blocks are angled. Thus, compression and expansion of gases in the cylinders can take place with a continuous motion of both the cylinder blocks and the pistons to eliminate the loss of efficiency of a conventional engine that has been described above.

In practice, the rotary vee engine has not lived up to the expectations that inventors have had for such engines. Because of the angled disposition of the rotating cylinder blocks and the firing of each cylinder at one side of the cylinder block, forces which tend to spread the two cylinder blocks into a straight line; that is, out of the vee configuration, are exerted on the cylinder blocks and such forces result in drag between the pistons and cylinder blocks that interferes with the operation and efficiency of the engine. Because of this problem, rotary vee engines have not enjoyed much success despite the promise that they hold and, indeed, it has been found that an engine constructed in the rotary vee configuration will often not even operate because of these problems that are inherent in the rotary vee configuration.

SUMMARY OF THE INVENTION

The present invention provides a rotary vee engine that solves this and other problems that have plagued the rotary vee engine and caused such engines to fail to live up to the hopes that have been placed in them. Thus, the present invention provides the operability that is necessary to exploit the advantages that are offered by engines of this type. It has been found that an operable rotary vee engine can be constructed by including in the engine an angled support shaft having portions that extend through the cylinder blocks along the axes of rotation of the cylinder blocks and having ends that are both supported by a housing in which the cylinder blocks are disposed. Bearings on the support shaft are located near each end of each cylinder block to transmit the forces that tend to spread the cylinder blocks out of the rotary vee configuration to the housing and thereby avoid any misalignment of the cylinder blocks that can, experience has shown, prevent the engine from operating.

An important object of the present invention is to provide a highly efficient internal combustion engine.

Another object of the present invention is to provide an internal combustion engine having the rotary vee configuration that eliminates problems that have been encountered in engines of this type.

Yet another object of the invention is to provide a rotary vee engine that is operable despite the inherent characteristics of such engines that have interfered with the operation of such engines in the past.

Other objects, ends and advantages of the engine of the present invention will become clear from the following detailed description of the engine when read in conjunction with the drawings and appended claims.

BRIEF DESCRIPTION OF THE DRAWINGS

FIG. 6 is a cross sectional view of the cylinder block assembly of the engine.

DESCRIPTION OF FIGS. 1 THROUGH 13

Figure 1:
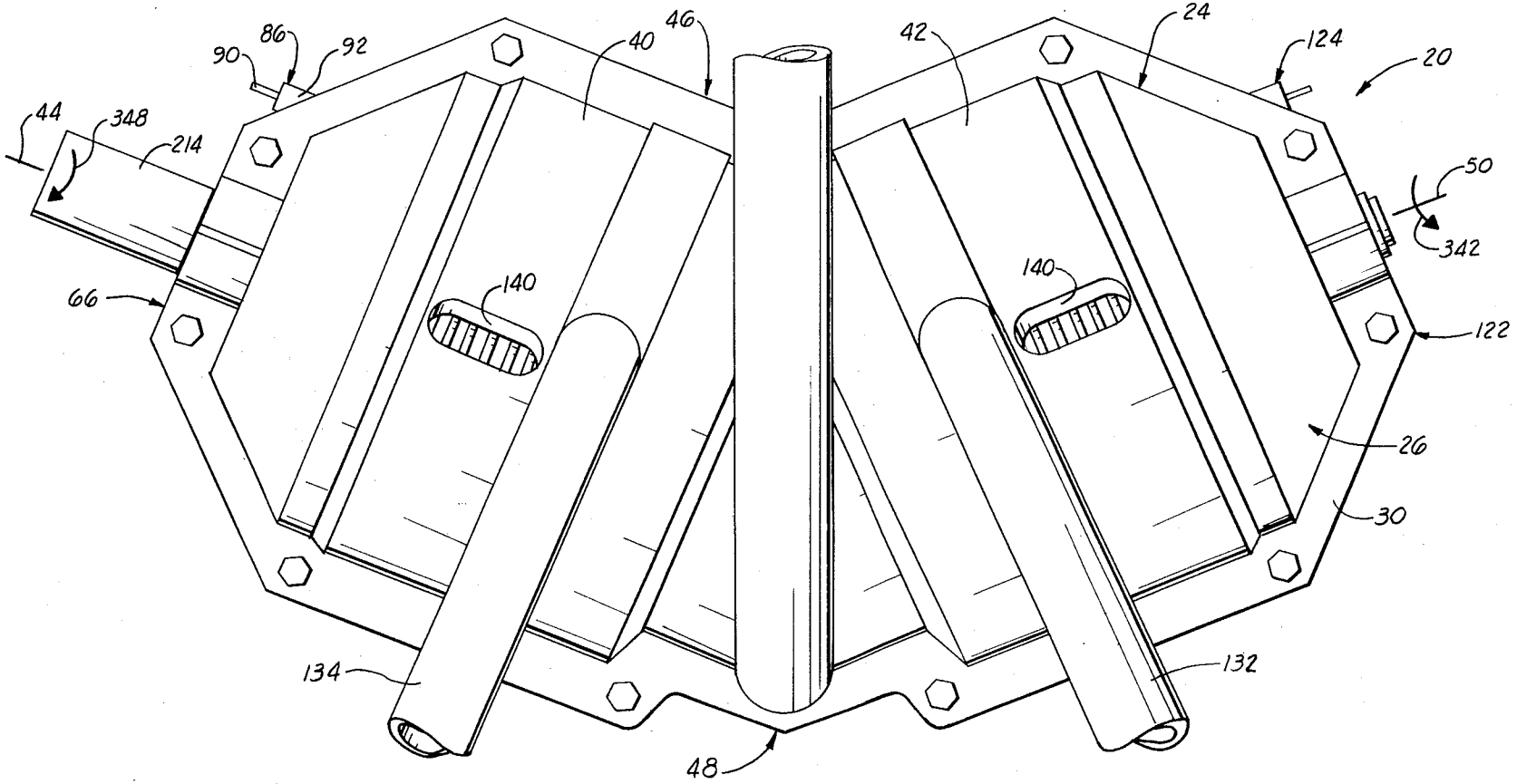
FIG. 1 is a plan view of one preferred embodiment of a rotary vee engine constructed in accordance with the present invention.

Referring now to FIGS. 1–13 in general and to FIGS. 1–5 in particular, shown therein and designated by the general reference numeral 20 is a rotary vee internal combustion engine constructed in accordance with the present invention. In general, the engine 20 is comprised of a cylinder block assembly 22 (FIG. 5) that is mounted in a housing 24 having a construction particularly shown in FIGS. 1–4.

In the preferred construction of the engine 20, the housing 24 is formed in two cast aluminum sections, an upper section 26 and a lower section 28 that can be fastened together about the cylinder block assembly 22 via flanges 30 and 32 that extend about lateral edges of the sections 26 and 28 respectively. (The flange 30 can be fastened to the flange 32 in any convenient manner; for example, by means of bolting the flange 30 to the flange 32.)

Figure 4:
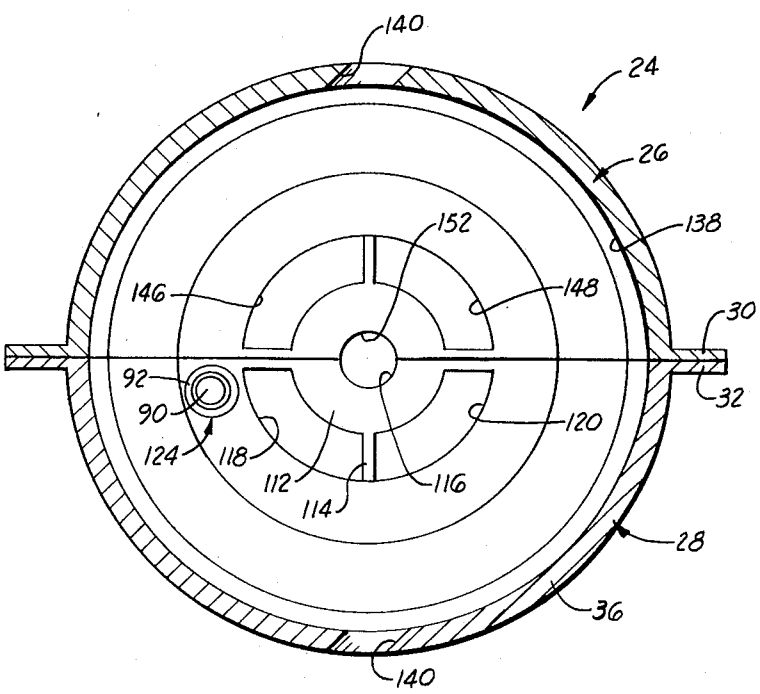
FIG. 4 is a cross sectional view of the engine housing taken along line 4—4 of FIG. 3.
Figure 2:
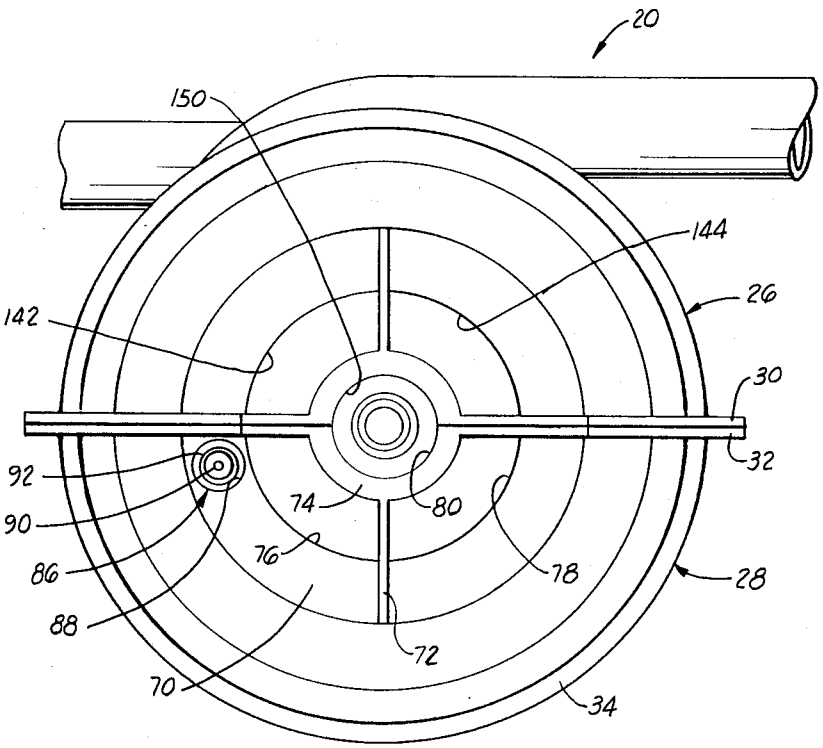
FIG. 2 is an elevational view of the drive shaft end of the engine.
Figure 3:
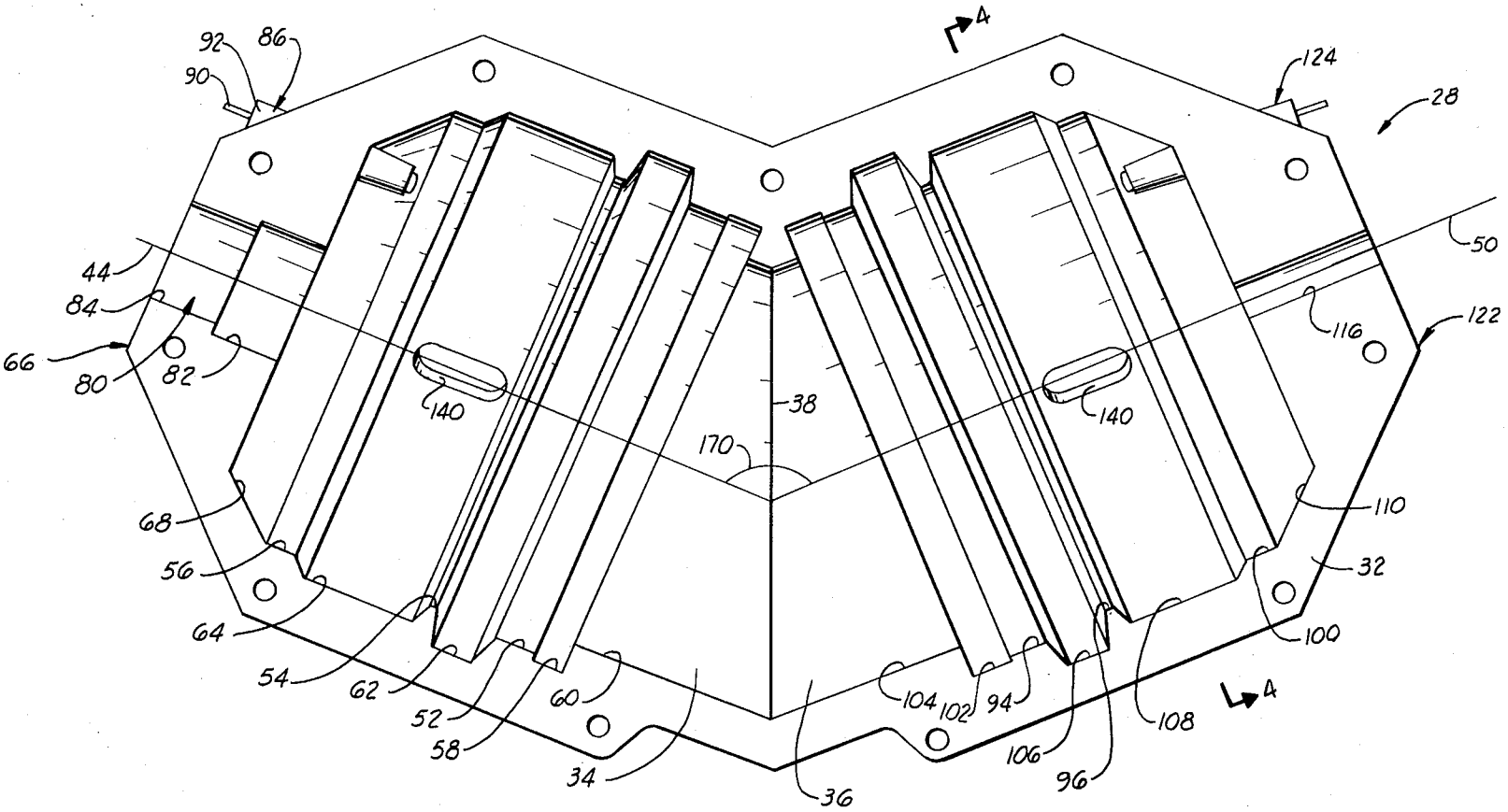
FIG. 3 is a plan view of the lower section of the engine housing.

Referring to FIGS. 3 and 4, the lower section 28 of the housing 24 has the form of a metal shell having two wall portions 34 and 36 that are each semi-cylindrical in configuration and meet at an angle at a center line 38 of the engine 20. The upper section 26 is similarly comprised of intersecting, semi-cylindrical wall portions 40 and 42 (FIG. 1) that similarly meet at an angle at the center line of the engine 20. Thus, when the two sections 26 and 28 of the housing 24 are fastened together as shown in FIGS. 1, 2 and 4, the wall portion 34 of the lower section 28 of the housing 24 cooperates with the wall portion 40 of the upper section 26 of the housing 24 to form a cylindrical cavity that meets a cylindrical cavity similarly formed by the wall portions 36 and 42, of the lower section 28 and upper section 26 of the housing 24 respectively, and the two cavities are angled with respect to each other in the manner that the semi-cylindrical wall portions 34 and 36 are angled one to another as shown in FIG. 3. In particular, the wall portions 34 and 40 form a cylindrical cavity (not numerically designated in the drawings) that is centered on a first rotation axis 44 that is angled toward a first side 46 of the engine and away from a second side 48 of the engine and the wall portions 36 and 42 similarly form a cylindrical cavity centered on a second rotation axis 50 that is similarly angled toward the first side 46 of the engine 20 and away from the second side 48 thereof.

Each of the wall portions 34, 36, 40 and 42 is comprised of a series of sections formed at different radii from the rotation axes 44 and 50 so that each of the cylindrical cavities formed by the combination of two wall portions, 34 and 40 and 36 and 42, will have a series of different diameter portions extending away from the center line 38 of the engine 20. In particular, and as shown in FIG. 3, the wall portion 34 has three base radius sections 52–56 extending serially away from the base line 38 with the base radius section 52 being separated from the base line 38 by an enlarged radius section 58, adjacent the base radius section 52, and a reduced radius section 60 between the enlarged radius section 58 and the center line 38. Between the base radius sections 52 and 54, the wall portion 34 of the lower housing section 28 has an enlarged radius section 62 and, similarly, an enlarged radius section 64 of the wall portion 34 is formed between the base radius sections 54 and 56. Near a first end 66 of the housing 24 (and of the engine 20) the wall portion 34 has a semi-conical section 68 that connects to a semi-ring shaped section 70 (FIG. 2) near the first end 66 of the engine 20. The flange 32 and a fin 72 mounted on the semi-ring shaped section 70 support a semi-cylindrical section 74 that extends axially from the semi-conical section 68 to the first end 66 of the housing 24. As can be seen in FIG. 2, the support of the semi-cylindrical section 74 by the fin 72 and the flange 32 leaves two openings 76 and 78 in the first end 66 of the housing 24.

A semi-cylindrical concavity 80, particularly shown in FIG. 3, is formed in the top of the semi-cylindrical section 74, centered on the first rotation axis 44, and the concavity 80 has an enlarged radius portion 82 facing the center line 38 of the engine 20 and a reduced radius portion 84 that extends to the first end 66 of the housing 24. As shown in FIGS. 1, 2, 3 and 5, a spark plug contactor assembly 86 is mounted in a hole 88 (FIG. 2) in the semi-ring shaped section 70 of the housing lower section 28 to extend through the first end 66 of the housing 24, the spark plug contactor assembly 86 being comprised of a conductor 90 extending through an insulating sleeve 92. During operation of the engine 20, the conductor 90 is connected to any suitable source of high voltage electricity to fire spark plugs, of which the engine 20 is comprised, that will be discussed below. It will be noticed that the contactor assembly 86 is displaced from the first rotation axis 44 in a direction toward the first side 46 of the engine 20 toward which the axes 44 and 50 are angled so that ignition can be effected by the spark plug contactor assembly 86 only when a spark plug fired thereby is positioned at the side of the engine 20 toward which the rotation axes 44 and 50 are angled.

The remaining three housing wall portions 36, 40 and 42 are provided with the same series of sections from the center line 38 as illustrated for the wall portion 36 in FIG. 3. Thus, corresponding to the sections 52, 54 and 56 of the wall portion 34, the wall portion 36 is provided with sections 94, 96 and 100; corresponding to the sections 58–68 of the wall portion 34, the wall portion 36 is provided with sections 102–110 (FIG. 3); and, corresponding to the semi-cylindrical section 74, having the concavity 80 formed in upper portions thereof to extend about the first rotation axis 44 at the first end 66 of the housing 24, the wall portion 36 is provided with a semi-cylindrical section 112 (FIG. 4), supported by a fin 114 and the flange 32, and having a semi-cylindrical concavity 116, centered on the second rotation axis 50 formed in the upper portions of the section 112. It will be noted that the construction and mounting of the section 112 thus provides openings 118 and 120 at a second end 122 of the housing 24. Similarly, the wall portion 36 has a spark plug contactor assembly 124, identical to the assembly 86, mounted thereon toward the first side 46 of the engine 20 from the rotation axis 50 in the same manner that the contactor assembly 86 is mounted on the wall portion 34 toward the first side 46 of the housing 24 from the first rotation axis 44. (As illustrated in the drawings, the contactors 86 and 124 are fixed on the housing 24. However, the contactors may be mounted on pivotable members, not shown, for spark advancement as is conventional.) Indeed, with one exception, the wall portion 36 is the mirror image, about the center line 38, of the wall portion 34. The exception, particularly shown in FIG. 2, is that the concavity 116 has a constant cross section throughout its length and has a radius of curvature that is less than the radii of curvature of the two portions of the concavity 80.

Figure 7:
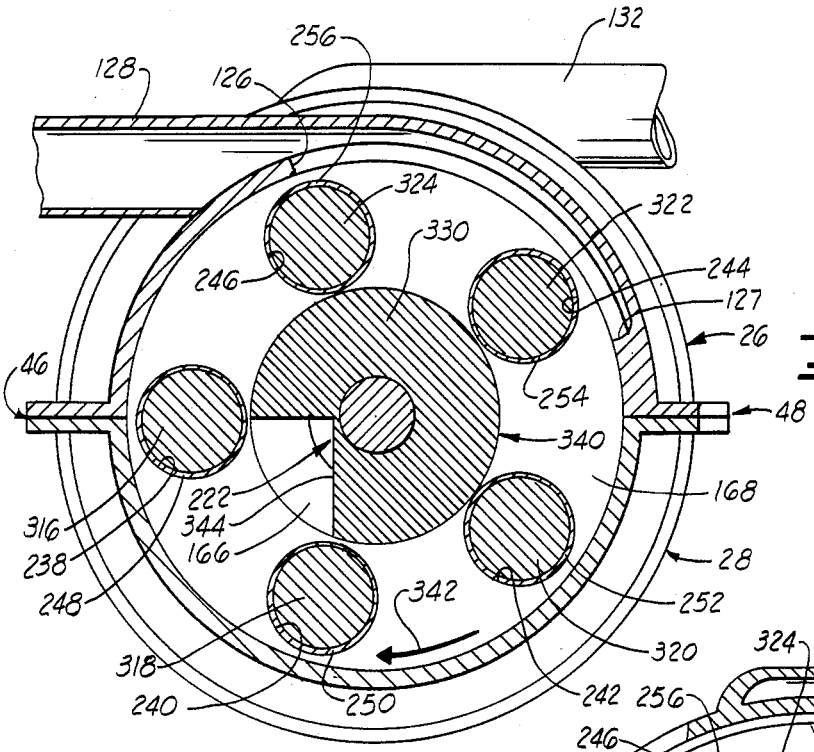
FIG. 7 is a cross section of the engine taken along line 7—7 of FIG. 5.
Figure 9:
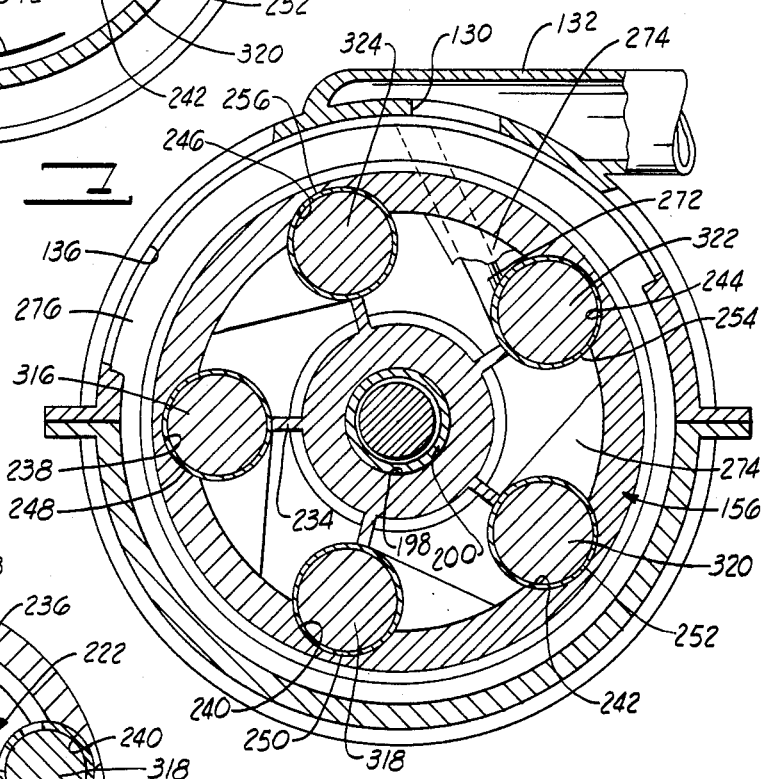
FIG. 9 is a cross section of the engine taken along line 9—9 of FIG. 5.

Similarly, the two wall portions 40 and 42 are substantially mirror images, about the meeting of the flanges 30 and 32, of the wall portions 34 and 36 respectively. The only differences are the lack of spark plug contactor assemblies in the wall portions 40 and 42 and additional structure on the wall portions 40 and 42 that have been illustrated in FIGS. 7 and 9. In particular, and as shown in FIG. 7, a slot 126, beginning at the top of the engine 20 and terminating at an end 127 near the second side 48 of the engine 20, is formed through the upper section 26 at the intersection of the wall portions (not numerically designated in FIG. 7) of the upper section and an air intake pipe 128 is welded to the upper section 26 over the slot 126 to provide for the entrance of air into central portions of the housing 24. Similarly, as shown in FIG. 9, an exhaust port 130 is formed through the wall portion 42 and an exhaust pipe 132 is welded over the exhaust port 130 to permit the exhaust of combustion products from the engine 20. A similar exhaust port (not shown) is formed through the wall portion 40 and an exhaust pipe 134 (FIG. 1) is welded over the exhaust port through the wall portion 40 to similarly permit the escape of combustion products from the engine 20.

From this symmetry of the wall portions 34, 36, 40 and 42, it will be seen that the sections of the wall portions having different radii of curvature cooperate to form a series of circumferentially extending grooves in the interior wall of the housing 24 when the housing 24 is assembled by mounting the upper case section 26 on the lower case section 28 and that the grooves so formed for portions of the housing 24 to one side of the center line 38 mirror the grooves in the side of the housing 24 to the other side of the center line 38. In particular, each half of the housing 24 to one side of the center line 38 is provided with a seal ring groove (the seal ring grooves, formed cooperatively by the section 58 of the wall portion 34 and the corresponding section of the wall portion 40 for lefthand portions of the engine 20 and by the section 102 of the wall portion 36 and the corresponding section of the wall portion 42 for the righthand portions of the engine 20, have not been numerically designated in the drawings); an exhaust groove, formed partially by the section 106 of the wall portion 36 (FIG. 2) and designated by the numeral 136 in FIG. 9, for the righthand side of the engine 20, into which the exhaust port 130 opens, and a similar exhaust groove formed in the lefthand side of the engine 20 by the section 62 of the wall portion 34 and the corresponding section of the wall portion 40; and an air discharge groove, formed partially by the section 108 and designated by the numeral 138 in FIG. 4 for the righthand side of the engine 20 and a similar air discharge for the lefthand side of the engine 20 provided by the section 64 of the wall portion 34 and the corresponding section of the wall portion 40. As shown in FIGS. 1, 3 and 4, an air discharge aperture 140 is formed through each of the wall portions 34, 36, 40 and 42 to intersect the air discharge groove, the apertures 140 providing for the discharge of cooling air that is drawn into the housing 24 via the openings 76 and 78 (FIG. 2) at the first end 66 of the engine 20, the openings 118 and 120 (FIG. 4) at the second end 122 of the engine 20; and corresponding openings 142–148 formed in the ends of the upper section 26 of the housing 24 as shown in FIGS. 2 and 4.

Similarly, the concavity 80 about the first rotation axis 44 at the first end 66 of the housing lower section 28 coacts with a corresponding concavity about the rotation axis 44 in the wall portion 40 to form a drive shaft bore extending through the first end 66 of the housing 24 when the housing 24 is assembled and the concavity 116, extending about the second rotation axis 50 at the second end 122 of the housing 24, coacts with a similar concavity formed about the rotation axis 50 in the wall portion 42 to form a support shaft support bore that extends through the second end 122 of the housing 24 when the housing 24 is assembled. The drive shaft bore has been designated by the numeral 150 in FIG. 2 and the support shaft support bore has been designated by the numeral 152 in FIG. 4.

Coming now to the cylinder block assembly 22, the cylinder block assembly 22 is comprised of first and second cylinder blocks 154 and 156, the constructions of which have been specifically illustrated in FIGS. 5–13. With one exception which will be noted below, the first cylinder block assembly 154 and the second cylinder block assembly 156 are identical so that it will not be necessary to describe both cylinder blocks 154 and 156 in detail. Rather, the cylinder block assembly 156 will be described in detail and the difference between the two cylinder blocks 154 and 156 will then be described. Identical features of the cylinder block 154 will be designated by the same numerical designations used for the cylinder block 156.

The second cylinder block 156 is generally cylindrical in shape, having an interior end 158 positioned, as will be discussed below, near the center line 38 of the engine 20 when the engine 20 is assembled, an exterior end 160, facing the second end 122 of the housing 24 when the engine 20 is assembled, and a generally circular periphery 162 that extends substantially from the interior end 158 to the exterior end 160. The periphery 162 is centered on a longitudinal axis of the cylinder block 156 that coincides with the second rotation axis 50 when the engine 20 is assembled and is an axis of rotation of the cylinder block 156 when the engine is operated. Similarly, the rotation axis 44 is the longitudinal axis of the cylinder block 154. Accordingly, the axes 44 and 50 have been illustrated in FIG. 6, which illustrates the cylinder block assembly in cross section, and the placement of features of the cylinder blocks will be described herein with respect to the rotation axes 44 and 50. (Portions of the periphery 162 are broken near the exterior end 160 by features of the cylinder block 156 that will be discussed below.)

Adjacent the interior end 158, the second cylinder block 156 is comprised of a base portion 164 having an annular flat surface 166, centered on the second rotation axis 50 and perpendicular thereto, formed thereon to form a central portion of the interior end 158. An annular beveled surface 168 is formed about the flat surface 166 to extend therefrom to the periphery 162 and the beveled surface 168 is cut at an angle toward the exterior end 160, from the flat surface 166, that is equal to one-half the supplement of the angle 170 (FIG. 3) at which the rotation axes 44 and 50 meet in the center of the engine 20. As a result, and as shown especially in FIG. 5, the cylinder blocks 154 and 156 can be axially positioned along the rotation axes 44 and 50 so that the beveled surface 168 on the interior end 158 will mate with the corresponding beveled surface 168 on the interior end 158 of the first cylinder block 154 at the side 46 of the engine 20 toward which the rotation axes 44 and 50 are angled. The purpose of beveling the interior ends of the cylinder blocks in this manner will be discussed below.

Figure 5:
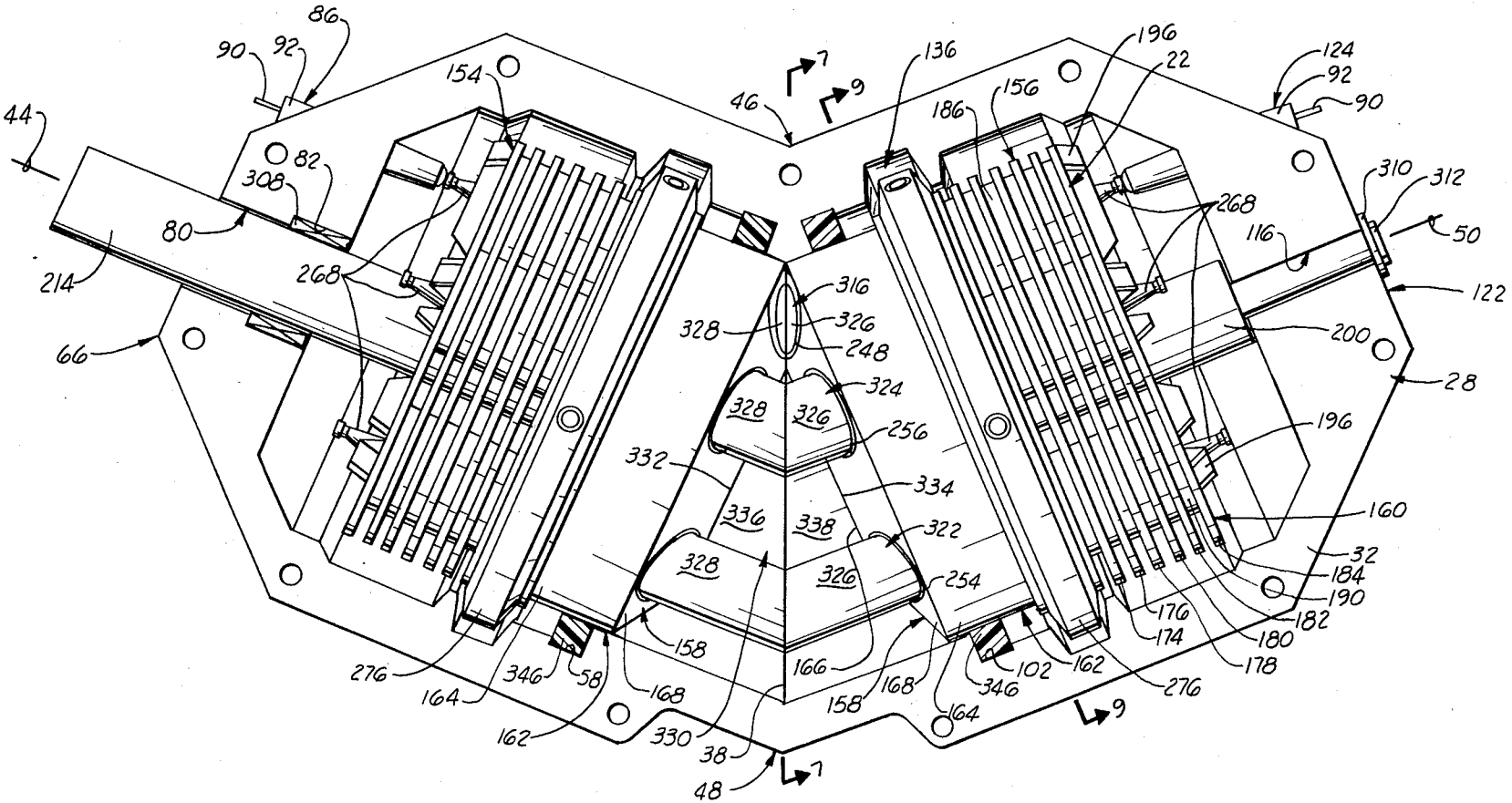
FIG. 5 is a plan view of the engine similar to FIG. 1 but with the upper section of the housing removed.
Figure 5:
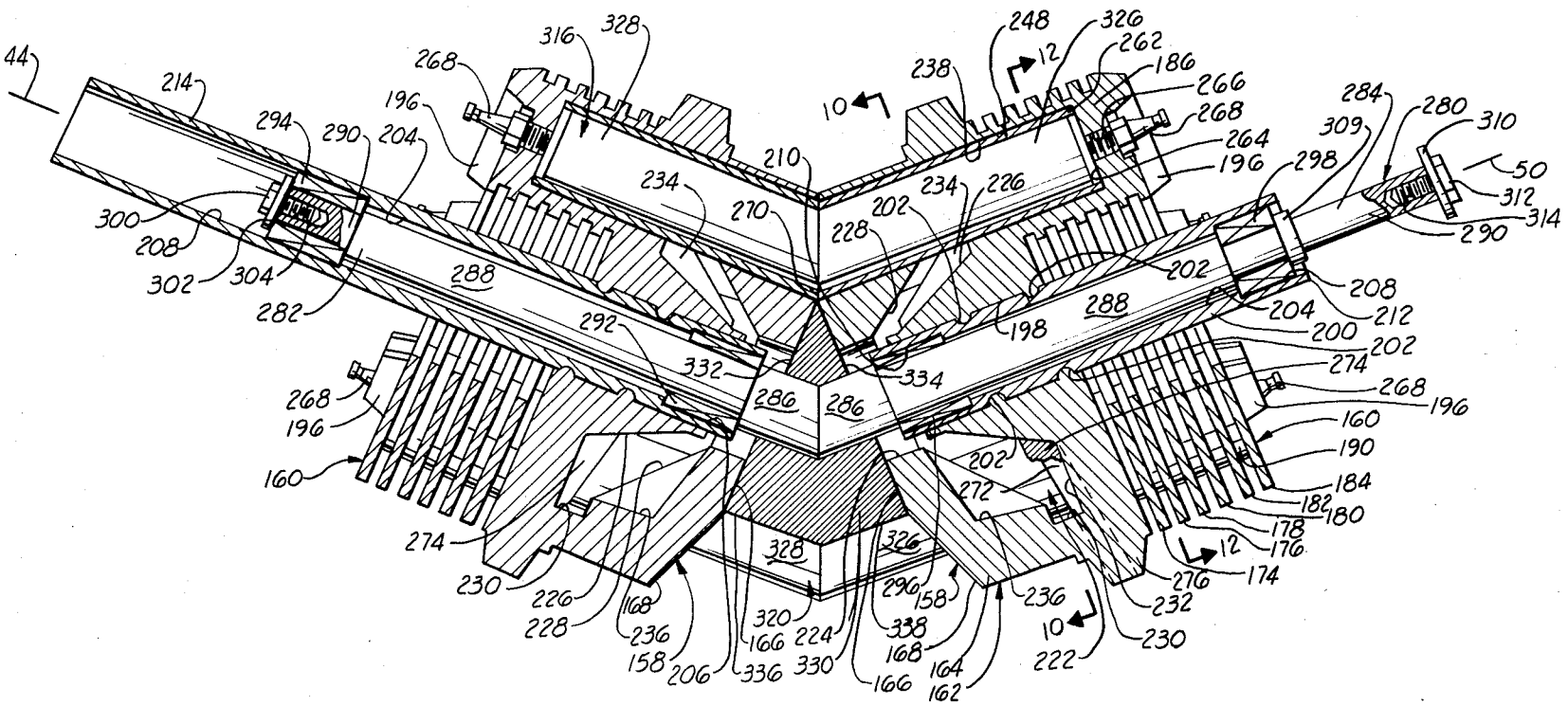

Between the base portion 164 and the exterior end 160 of the second cylinder block 156, the second cylinder block 156 is further comprised of a plurality of coaxial rings 174–184 centered on the rotation axis 50 and positioned in a spaced series from the base portion 164 to the exterior end 160 of the cylinder block 156. The rings 174–184 are positioned via axially extending cylindrical members 186–194 (FIGS. 6 and 12) that are equidistant from the rotation axis 50 and are symmetrically positioned in a ring thereabout. As shown in FIGS. 5, 6 and 13, a plurality of fins 196 are formed on the ring 184 at the exterior end 160 of the cylinder block 156 to provide for cooling of the engine 20 in a manner that will be discussed below. Preferably, the base portion 164, the rings 174–184, and the cylindrical members 186–194 are formed integrally by a one-step aluminum casting operation.

An axial bore 198 (FIGS. 6 and 9), centered on the rotation axis 50, is formed through the base portion 164 and the cylinder block 156 further comprises an idler shaft 200 that is mounted in the bore 198. In particular, the idler shaft 200 is preferably permanently mounted in the cylinder block 156 by placing the idler shaft 200 in the mold used for casting other portions of the cylinder block 156 before molten aluminum is poured into such mold. In order to secure the idler shaft 200 firmly to remaining portions of the cylinder block 156, depressions 202 are formed in the outer peripheral surface of the idler shaft 200 prior to the casting of the cylinder block 156.

As shown in FIG. 6, the idler shaft 200 has the form of a tube so that the bore 204 of the idler shaft 200 forms a central bore for the second cylinder block 156. Counter bores 206 and 208 are formed in an interior end 210 of the idler shaft, adjacent the interior end 158 of the cylinder block 156, and an exterior end 212 of the idler shaft, adjacent the exterior end 160 of the cylinder block 156, for a reason to be discussed below. The first cylinder block 154 differs from the second cylinder block 156 only in that the idler shaft 200 of the second cylinder block 156 is replaced in the first cylinder block 154 with a tubular drive shaft 214 having an interior end 210 adjacent the interior end 158 of the first cylinder block 154 and an exterior end 212 that protrudes from the exterior end 160 of the first cylinder block 154 a distance that is greater than the protrusion of the idler shaft 200 from the exterior end 160 of the second cylinder block 156. The purpose for protruding the drive shaft 214 a greater distance from the exterior end of the first cylinder block 154 than the idler shaft 200 is protruded from the exterior end of the second cylinder block 156 will become clear below. Like the idler shaft 200, the drive shaft 214 has a bore 204 forming a central bore for the first cylinder block 154 and the bore 216 is provided with the counterbores 206 and 208 that are also provided the idler shaft 200.

Figure 10:
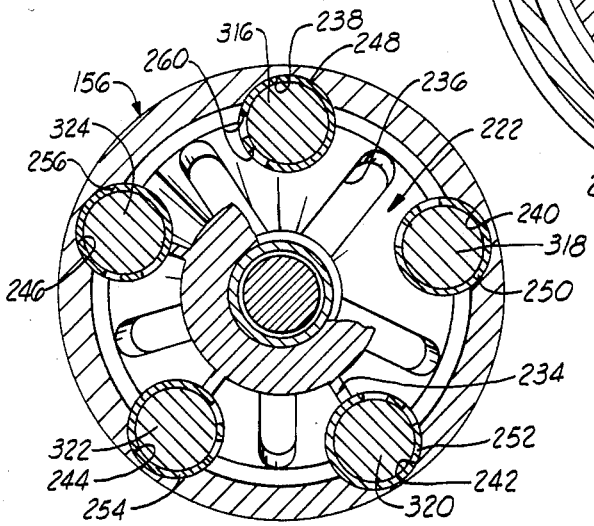
FIG. 10 is a cross section of a cylinder block taken along line 10—10 of FIG. 6.

As is particularly shown in FIGS. 6 and 10, a cavity 222 is formed in the base portion 164 of the cylinder block 156 to intersect the flat surface 166 of the interior end 158 of the cylinder block 156. More particularly, the cavity 222 has an annular portion formed by a cylindrical surface 224 that intersects the flat surface 166; a steadily widening portion formed by a conical innermost wall 226 formed on radially innermost portions of the base portion 164 to diverge away from the interior end 158 and a conical outermost wall 228 formed on radially outermost portions of the base portion 164 to extend about the innermost wall 226 and diverge from the interior end 158 at a greater angle than the angle of divergence of the innermost wall 226; and an annular groove 230 that extends about the large end of the outermost wall 228. An annular wall 232 extends between the outer wall of the groove 230 and the innermost wall 226 to close the end of the cavity 222 that is remote from the interior end 158 of the cylinder block 156. As will be discussed below, the cavity 222 acts as a manifold for the injection of fuel and air into cylinders that are formed in the cylinder block 156 in a manner also to be discussed below. In the operation of the engine 20, it is desirable that these gases be injected under pressure into the cylinders formed in the cylinder block and a contribution to such injection is made by features that are formed on the innermost and outermost walls, 226 and 228 respectively, of the cavity 222. In particular, and as shown in FIGS. 6, 9 and 10, a plurality of radially extending fins are formed on the innermost surface 226 of the cavity 222 to extend in a symmetric array therefrom. Similarly, a slot 236 is formed in the outermost wall 228 each pair of the fins 234. The fins 234 and slots 236 mechanically couple air in the cavity 222 to the cylinder block 156 so that the fins 234 and the slots 236 will impart the rotational motion of the cylinder block 156 during operation of the engine 20 to air and fuel in the cavity 222 and thereby give rise to centrifugal forces on the gases in the cavity 222 that will establish a pressure gradient toward radially outermost portions of the cavity 222 at which, as will be discussed below, air and fuel are injected into cylinders formed in the cylinder block 156.

Figure 11:
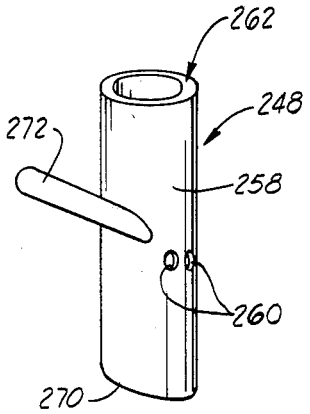
FIG. 11 is an isometric view of a cylinder sleeve of the engine.
Figure 12:
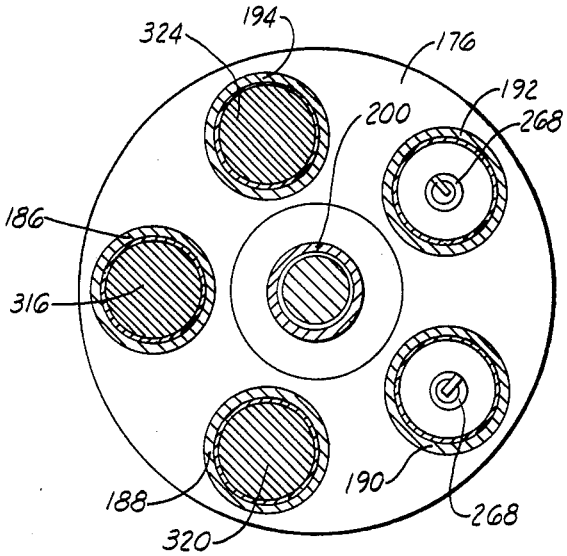
FIG. 12 is a cross section of a cylinder block taken along line 12—12 of FIG. 6.
Figure 13:
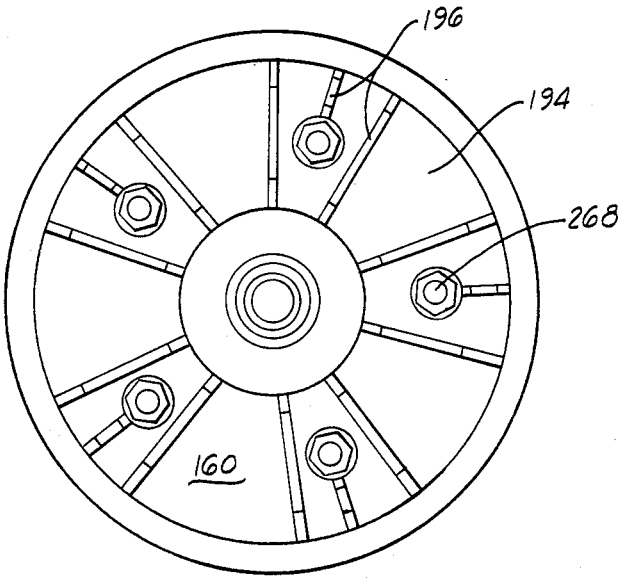
FIG. 13 is an end elevational view of one of the cylinder blocks of the engine.

As shown in FIG. 12, the cylindrical members 186–194 are positioned symmetrically about the idler shaft 200 and, as can be seen by comparing FIGS. 9, 10 and 12, the number of cylindrical members 186–194 is equal to the number of fins 234 and slots 236 formed on and in the walls of the cavity 222. In particular, each cylindrical member 186–194 is radially aligned with one of the fins 234 and bores 238–246 are formed through central portions of the cylindrical members 186–194 to intersect the cavity 222 and the beveled portion 168 of the interior end 158 of the cylinder block 156. Cylinders for the cylinder block 156 are then formed via tubular sleeves 248–256 that are mounted in the bores 238–246, parallel to the rotation axis 50, to extend the lengths of the bores 238–246. The sleeves 248–256 are constructed identically and such construction has been shown for the sleeve 248 in FIG. 11. In particular, the sleeve 248 is comprised of a tubular wall 258 having two intake ports 260 formed therethrough, the intake ports 260 being axially positioned so that the intake ports will align with the cavity 222, substantially at a level with the groove 230, when the sleeves 248–256 are disposed within the bores 238–246. As can be seen in FIG. 10, the intake ports 260 of the sleeve 248 and the corresponding intake ports of the sleeves 250–256 are positioned within the cavity 222 to be located in radially outermost portions of the cavity 222 so that the above-described rotational motion of air and fuel within the cavity 222 will have a tendency to force the air and fuel into the interiors of the sleeves 248–256.

Referring once again to FIG. 11 and additionally to FIG. 6, the wall member 258 of the sleeve 248 has an upper end 262 that is positioned near the exterior end 160 of the cylinder block 156 to engage an annular wall 264 that forms an end to the cylinder (not numerically designated in the drawings) provided by the sleeve 248. A threaded bore 266 is formed through portions of the cylinder block between the wall 264 and the exterior end 160 of the cylinder block 156 to receive a spark plug 268 utilized for initiating combustion of a fuel/air mixture disposed within the cylinder provided by the sleeve 248. As shown in FIG. 11, the wall member 258 similarly has a lower end 270 that is cut at an angle to the axis of the wall member 258 so that the lower end 270 of the wall member 258 of the sleeve 248 will be flush with the beveled surface 168 on the interior end 158 of the cylinder block 156 when the sleeve 248 is disposed in the bore 238.

In addition to the intake ports 260, an exhaust port (not shown) is formed through the wall member 258 and an exhaust tube 272 is welded over the exhaust port to extend upwardly, with respect to the upper and lower ends 262, 270 of the wall member 258, and away from the wall member 258. The exhaust tube, serves both to transmit combustion products from the cylinders of the cylinder block 156 and, further, to anchor the sleeves 248–256 to remaining portions of the cylinder block 156. This latter function has been illustrated for the exhaust tubes 272 of the sleeves 252 and 254 in FIGS. 6 and 9 respectively. Prior to the casting of the base portion 164, the cylindrical members 186–194 and the rings 174–184, the sleeves 248–256 are placed in the mold and postioned so that the intake ports 260 will be located as shown in FIG. 10 for the sleeve 248 and so that the exhaust tubes 272 will be positioned as shown in FIGS. 6 and 9 for the sleeves 252 and 254 respectively. A sand casting is nested among the sleeves 248–256 to form the cavity 222 and notches are formed in the sand casting to permit the exhaust tubes 272 to be extended to the periphery of the mold. When the base portion 164, cylindrical members 186–194 and rings 174–184 are subsequently cast, the notches in the sand casting that forms the cavity 222 will permit molten aluminum to flow about the exhaust tubes 272 and form a mass of aluminum 274 about each exhaust tube 272 as shown in FIGS. 6 and 9.

As also shown in FIGS. 6 and 9, portions of the periphery 162 of the cylinder block 156 that are intersected by the exhaust tubes 272 are formed on an enlarged diameter to provide an exhaust ring 276 that extends circumferentially about the base portion 164 of the cylinder block 156. As shown in FIGS. 5 and 9, the exhaust ring 276 is disposed in the exhaust groove 136 of the housing 24 when the engine 20 is assembled so that exhaust gases transmitted from the cylinders to the periphery of the exhaust ring 276 via the exhaust tubes 272 of the sleeves 248–256 will enter the exhaust groove 136 and be transmitted therefrom through the slot 130 to the exhaust pipe 132 for discharge from the engine 20. Discharge of combustion products is effected in the same manner for the first cylinder block 154 as indicated by the location of the exhaust ring 276 of the first cylinder block 154 in FIG. 5 and the location of the exhaust pipe 134 in FIG. 1.

Before continuing with the description of the engine 20, it will be useful to briefly summarize the construction of the cylinder blocks 154 and 156. As can be seen from the above description of the cylinder block 156, and the notation above that the cylinder blocks differ only in the shapes of the idler shaft 200 and drive shaft 214, each of the cylinder blocks 154, 156 has a longitudinal axis which, in the assembled engine 20, lies along one of the rotation axes 44 and 50. In particular, the longitudinal axis of the cylinder block 154 lies along the first rotation axis 44 and the longitudinal axis of the second cylinder block 156 lies along the second rotation axis 50. A plurality of symmetrically spaced, axially extending cylinders are formed about the rotation axis for each cylinder block 154, 156 by means of sleeves that are cast into remaining portions of the cylinder block 154, 156. Spark plug bores 266 are formed between each cylinder and the exterior end 160 of each cylinder block 154, 156 to receive spark plugs 268 by means of which gases in the cylinders can be ignited. The sleeves in which the cylinders are formed extend in a ring about a cavity 222 formed in the base portion of each of the cylinder blocks 154 and 156 and intake ports are formed through wall members 258 of the sleeves to provide fluid communication between the cavities and the interiors of the cylinders so that a fuel/air mixture can be introduced into each of the cylinders via the cavity 222 in the base portion of the cylinder block. Discharge tubes 272, opening into the interiors of the wall members 258 of the sleeves, are welded to the sleeves and extend to the periphery of a discharge ring 276 that is formed on the periphery of the base portion 164 of each of the cylinder blocks 154, 156. It will also be noted that central portions of each of the cylinder blocks 154, 156 adjacent the exterior end 160 thereof have an open structure because of the formation of such portions of the cylinder block via the rings 174–184 which are held in a spaced apart relation by the cylindrical members 186–194 in which the cylinders of the cylinder blocks 154, 156 are formed. Thus, air can circulate freely about portions of the cylinders that are located near the exterior end 160 of each of the cylinder blocks 154, 156.

Returning now to the construction of the engine 20, an important aspect of the invention is the manner in which the cylinder blocks 154 and 156 are mounted in the housing 24. Such mounting is particularly shown in FIGS. 5 and 6.

Referring first to FIG. 6, the engine 20 is further comprised of a support shaft 280 which has a first portion 282 and a second portion 284 that are angled one to another at the same angle that the rotation axes 44 and 50 are angled one to another. Each portion 282, 284 has a large diameter portion 286 that meets the large diameter portion 286 of the other portion of the support shaft; an intermediate diameter portion 288 that extends axially from the large diameter portion 286 of the support shaft end portion; and a small diameter portion 290 that extends axially from the intermediate diameter portion 280 to the end of the end portion of the support shaft. The intermediate diameter portions 288 and small diameter portions 290 of the support shaft end portions 282 and 284 are made smaller than the diameters 204 of the central bores of the idler shaft 200 and drive shaft 214 so that the drive shaft 214 can be mounted on the first end portion 282 of the support shaft 280 and the idler shaft 200 can similarly be mounted on the intermediate diameter portion 288 of the second end portion 284 of the support shaft 280.

The engine 20 further comprises a first pair of spaced apart bearings, comprised of a bearing 292 that slides onto the intermediate diameter portion 288 of the first end portion 282 of the support shaft 280 and a bearing 294 that fits on the small diameter portion 290 of the first end portion 282 of the support shaft 280. The bearings 292 and 294 fit within the counterbores, 206 and 208 respectively, in the bore 204 of the drive shaft 214 and a screw 300 and washer 302 are mounted on the distal end of the first end portion 282 of the support shaft, via a threaded bore 304 that is formed in the distal end of the first end portion 282 of the support shaft 280, to fix the position of the bearings 292 and 294 between shoulders formed by the variation in diameters of the portions 286–290 of the first end portion 282 and shoulders formed by the counter bores 206 and 208 formed in the bore 216 of the drive shaft 214. Thus, the bearings 292 and 294 axially position the first cylinder block 154 on the first end portion 282 of the drive shaft 280 and, further, support both the interior end 158 and the exterior end 160 of the first cylinder block 154. Similarly, a second pair of spaced apart bearings, comprised of bearings 296 and 298 are mounted on the intermediate and small diameter portions 288 and 290 respectively, of the second end portion 284 of the support shaft 280, to reside in the counterbores 206 and 208 respectively, and thereby similarly axially position the second cylinder block 156 on the second end portion 284 of the support shaft 280 and to similarly support both the interior and exterior ends, 158 and 160 respectively, of the second cylinder block 156 on the support shaft 280. The bearings 296 and 298 are held in position on the second end portion 284 of the support shaft 280 by means of a bushing 309 that mounts on the small diameter portion 290 of the second end portion 284 of the support shaft 280 to abut the bearing 298. The bushing 309 can be conveniently clamped to the support shaft 280 via a set screw (not shown). Preferably, the bearings 292–298 are of the radial-thrust type to provide both radial and axial support for the cylinder blocks 154 and 156 on the support shaft 280.

It will be noted that both the drive shaft 214 and the reduced diameter portion 290 of the second end portion 284 of the support shaft 280 extend axially outwardly of the bearings 294 and 298 on the small diameter portions 290 of the end portions 282 and 284 of the support shaft 280 and such extension facilitates the mounting of the cylinder block assembly 22 in the housing 24 in the manner indicated in FIG. 5. In particular, a bearing 308 is mounted on the drive shaft 214 to be positioned within the enlarged radius portion 82 of the semi-cylindrical concavity 80 in the lower housing section 28. Similarly, the extensive end of the small diameter portion 290 of the second end portion 284 of the support shaft 280 has a radius equal to the radius of the semi-cylindrical cavity 116 formed in the lower case section 28 so that the cylinder block assembly 22 can be mounted on the lower case section 28 by dropping the cylinder block assembly into the lower case section 28 with the drive shaft 214 and bearing 308 disposed in the concavity 80 and with extensive portions of the small diameter portion 290 of the second end portion of the drive shaft 280 disposed in the concavity 116. The engine can then be assembled by placing the upper case section 26 on the lower case section 28, and fastening the upper case section 26 to the lower case section 28, thereby forming the drive shaft bore through the first end 66 of the housing 24 and forming the support shaft bore through the second end 122 of the housing 24, in the manner described above, with the drive shaft 214 rotatably passing through the drive shaft bore and the small diameter portion 290 of the second end portion 284 of the support shaft 280 being firmly clamped in the support shaft bore. A washer and screw, 310 and 312, are then screwed into a bore 314 (FIG. 6) formed in the end of the small diameter portion 290 of the second end portion 284 of the support shaft 280 to fix a portion of the case 24 between the washer 310 and the bushing 309 so that the cylinder block assembly 22 will be positioned within the housing 24 as shown in FIG. 5.

It will thus be seen that both ends of the support shaft 280 are supported by the housing 24 and that both of the cylinder blocks 154 and 156 are rotatably mounted, with support at both ends of each of the cylinder block 154 and 156, within the housing 24. The support shaft 280 is made of a rigid steel and is constructed on a diameter such that, with the support of the ends of the support shaft 280 on the housing 24, the support shaft 280 will absorb any tendency of the cylinder blocks 154 and 156 to pivot about the intersection of the rotation axes 44 and 50 to interfere with the operation of the engine 20 as has occurred for rotary vee engines in the past.

The placement of the cylinder blocks 154 and 156 in the housing 24 as illustrated in FIG. 5 also provides very efficient air cooling of the cylinder blocks 154 and 156 during the operation of the engine 20. As can be seen by comparing FIG. 5 to FIGS. 2 and 4, such placement of the engine results in the openings 76, 78, 142 and 144 in the first end of the engine 20 (FIG. 2) being disposed axially of the exterior end 160 of the first cylinder block 154 and, similarly, the openings 118, 120, 146 and 148 (FIG. 4) will be disposed axially of the exterior end 160 of the second cylinder block 156. Moreover, as can be seen by comparing FIGS. 1 and 5, the rings 174–184, which comprise portions of the cylinder blocks 154 and 156 are axially aligned, in the assembled engine 20, with the sections 64 and 108 of the wall portions 34 and 36 of the lower case section 28 so that the series of rings for both cylinder blocks 154 and 156 will be axially aligned with the apertures 140 formed through the air discharge groove 138 that is formed by the sections 64 and 108 and corresponding sections of the upper case section wall portions 40 and 42. Thus, rotation of the cylinder blocks 154 and 156 about the rotation axes 44 and 50 will cause the fins 196 of the cylinder blocks 154 and 156 to draw air into the housing 24 through the openings 76, 78, 142, 144, 118, 120, 146 and 148, circulate the air through the series of rings comprising a portion of each of the cylinder blocks 154, 156 at the exterior ends 160 thereof and about the cylindrical members in which the cylinders of the cylinder blocks are formed, and to discharge the cooling air through the apertures 140 that are formed through each of the wall portions of each of the sections of the housing 24.

Referring once again to FIGS. 5, 6, 7, 9, 10 and 12, the engine 20 is further comprised of a plurality of pistons 316–324 that each have a portion 326 (FIGS. 5 and 6) that is disposed in one of the cylinders of the second cylinder block 156 and another portion 328 that is angled with respect to the portion 326 to extend into a corresponding cylinder formed in the cylinder block 154. The pistons 316–324, which can conveniently be constructed of aluminum bar, are identical to each other and the portion 326 of each piston 316–324 is equal in length to the portion 328 of each piston 316–324. Accordingly, the extents to which the portions 326 and 328 of a piston will enter the cylinders in the cylinder blocks 154 and 156 will be equal and, because of the angling of the cylinder blocks 154 and 156 toward the first side 46 of the engine 20, will vary with the angular positions of the pistons about the rotation axes 44 and 50. For example, as shown in FIGS. 5 and 6, the portions 326 and 328 of the piston 316 are substantially completely contained within two cylinders, one in each cylinder block 154 and 156, because the piston 316 is disposed adjacent the first side 46 of the engine 20 while the portions 326 and 328 of the pistons 320 and 322 are displaced from the cylinder blocks 154 and 156 because the pistons 320 and 322 are adjacent the second side 48 of the engine 20. Thus, rotation of the cylinder blocks 154 and 156 will result in expansion and contraction of the free volumes of the cylinders formed in the sleeves 248–256 to enable compression and expansion of gases in such cylinders via rotation of the cylinder blocks 154 and 156. The lengths of the portions 326 and 328 of the pistons 316–324 are selected such that the intake ports 260 in each of the sleeves 248–256 will be uncovered by the piston in the sleeve at such times that the sleeve reaches an angular position in the housing 24 in which the sleeve is adjacent the flanges 30 and 32 at the second side 48 of the engine 20. As will be clear from the above-described construction of the engine 20, such position of the sleeve will result in a maximum free volume for the cylinder that is defined by the sleeve.

Figure 8:
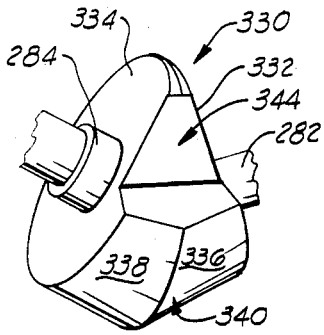
FIG. 8 is an isometric view of the supercharging block of the engine illustrating the mounting of the supercharging block on the engine support shaft.

As shown in FIGS. 5 and 6 for the sleeves 248, 254 and 256, the sleeves 248–256 intersect the beveled surface 168 on the interior end 158 of the second cylinder block 156 and extend nearly across the entire radial extent of the beveled surface 168. A similar relationship exists between the sleeves of the first cylinder block 154 and the beveled surface 168 thereof. Moreover, the base portions 164 of the cylinder blocks 154 and 156 are formed on a diameter to mate with the inner surfaces of the sections 104 and 60 of the wall portions 36 and 34 and corresponding sections of the wall portions 42 and 40 so that the pistons 316–324 are positioned in close proximity to central portions of the interior surface of the housing 24 when the cylinder block assembly 22 is assembled with the housing 24. Moreover, the engine 20 further comprises a supercharging block 330 constructed as shown in FIG. 8 and mounted on central portions of the support shaft 280 as shown in FIGS. 6–8 to be nested within the pistons 316–324. The supercharging block 330 has opposite, flat, circular ends 332 and 334 that are sized to overlay the flat surfaces 166 formed on the interior ends of the cylinder blocks 154 and 156 and the surfaces 332 and 334 converge so that the surfaces 332 and 334 meet at one side of the supercharging block 330 as shown in FIG. 8. In particular, the angle of convergence is such that the ends 332 and 334 of the supercharging block 330 will be perpendicular to the rotation axes 44 and 50 at such times that the supercharging block 330 is mounted on the support shaft 280 with the direction of convergence of the ends 334 and 336 from the support shaft 280 the same as the direction that the support shaft portions 282 and 284 are angled from a straight line. The supercharging block 330 can be conveniently made in two portions (not shown), each having a central bore formed therethrough (not numerically designated in the drawings) for mounting the supercharging block on the support shaft 280.

The diameters of the ends 332 and 334 of the supercharging block 330 are made equal to the diameters of the flat surfaces 166 on the interior ends 158 of the cylinder blocks 154 and 156 so that, with the convergence of the ends 332 and 334 to meet at one side of the supercharging block 330, the surfaces 332 and 334 can be juxtaposed with the surfaces 166 on the interior ends of the cylinder blocks 154 and 156 as shown in FIG. 6. The periphery of the supercharging block is defined by two substantially cylindrical surfaces 336 and 338 that are centered on the rotation axes 44 and 50 so that, with the above-described positions of the sleeves in the cylinder blocks 154 and 156, central portions of the pistons 316–324 will be in close proximity to the periphery, generally designated 340, of the supercharging block as shown in FIG. 7. It will thus be seen that the periphery 340 of the supercharging block 330, the beveled surfaces 168 on the interior ends 158 of the cylinder blocks 154 and 156, and the inner surface of central portions of the housing 24 will define an annular chamber (not numerically designated in the drawings) in which the pistons 316–324 circulate as the cylinder blocks 154 and 156 rotate in the housing 24. Moreover, as is indicated by the positions of the beveled surfaces 168 on the interior ends of the cylinder blocks 154 and 156 in FIGS. 5 and 6, the annular chamber so formed will have a length that decreases from a maximum at the second side 48 of the engine 20 to substantially zero at the first side 46 thereof. Thus, at times that the cylinder blocks are rotated in the direction 342 shown in FIG. 7, air in the intake pipe 128 will be drawn into central portions of the housing 24 through the slot 126 by a movement of the pistons in the annular chamber and compressed as the pistons circulate to move in a direction toward the first side 46 of the engine 20. A notch 344 is cut in the supercharging block 330 to intersect the ends 334 and 336 thereof, near the lateral intersection of such ends, and below the center of the support shaft 280 as shown in FIG. 7. The notch 344 is extended into the body of the supercharging block 330 a distance sufficient to overlay the openings of the cavities 222 in the cylinder blocks 154 and 156 at the surfaces 166, as shown for the cylinder block 156 in FIG. 7, so that rotation of the cylinder blocks 154 and 156 will cause an injection of air and fuel in the intake pipe 128 into the cavities 222 formed in the cylinder blocks 154 and 156 and, thence, into the cylinders formed in the cylinder blocks 154 and 156, by the sleeves 248–256, via the intake ports 260 (FIGS. 10 and 11) formed through the sleeves 248–256.

In order to separate central portions of the interior of the housing 24, in which fuel and air are injected via the intake pipe 128, from end portions of the housing 24, from which combustion products are discharged from the engine 20 via the exhaust pipes 132 and 134 and in which cooling air is circulated, a seal ring 346 (FIG. 5) is mounted in the seal ring groove formed by the sections 58 and 102 of the wall portions 34 and 36 of the lower case section 28 and the corresponding sections of the wall portions 40 and 42 of the upper case section 26. The inner diameters of the seal rings 346 are made sufficient to mate with the peripheries 162 of the base portions 164 of the cylinder blocks 154 and 156 so that the inner surfaces of the seal rings 346 will form a seal with the cylinder blocks 154 and 156 that will interrupt fluid communication between the center portion and the end portions of the chamber formed in the housing 24 by the housing sections 26 and 28.

Operation

To operate the engine 20, a source of high voltage electricity (not shown) is connected to the central conductors 90 of each of the spark plug contactor assemblies 86 and 124 and a carburetor (not shown), connected to a suitable source of fuel, is fluidly connected to the intake pipe 128 so that a fuel and air mixture can be supplied to cylinders of the engine 20 and ignited by the spark plugs 268 mounted in the exterior ends 160 of the cylinder blocks 154 and 156. The drive shaft 214 is then rotated in the direction 348 shown in FIGS. 1 and 5 to similarly rotate the cylinder blocks in the directions 348 and 342 for the first cylinder block 154 and the second cylinder block 156 respectively.

Assuming that the engine 20 is initially in a configuration in which the pistons 316–324 are in the positions shown in FIG. 7, a mixture of fuel and air will enter central portions of the housing 24 via the slot 126 so that portions of the annular chamber formed by the interior wall of the housing 24, the periphery 340 of the supercharging block 330, and the bevels 168 on the interior ends of the cylinder blocks 154 and 156 will receive the fuel/air mixture between the pistons 320 and 322 as well as between the pistons 322 and 324. As the piston 322 passes by the end 127 of the slot 126, the fuel/air mixture between the pistons 320 and 322 will be trapped and moved in a circle toward the first side 46 of the engine 20 so that, because of the decrease in the length of the chamber in which the pistons 316–324 circulate toward the first side 46, the fuel/air mixture between the pistons 320 and 322 will be compressed as the mixture is moved in the direction 342 about the supercharging block 330. As rotation continues, the angular gap between the pistons 320 and 322 will reach the notch 344 in the supercharging block 330 so that such gap will come into fluid communication with the cavities 222 in the interiors of the cylinder blocks 154 and 156. Because of the juxtaposition of the beveled surfaces 168 on the interior ends of the cylinder blocks 154, 156, the fuel/air mixture will be highly compressed as the gap between two pistons moves past the notch 344 so that the fuel/air mixture in the gap will be injected under pressure into the cavities 222. As the pistons continue to circulate about the supercharging block 330, additional charges of fuel/air mixture will be drawn into the engine 20 between successive pairs of pistons, compressed, and injected into the cavities 222 in the same manner that has been described above with respect to the pistons 320–322.

Moreover, because of the fins 234 formed on the innermost surfaces 226 and the slots 236 formed in the outermost surfaces 228 of the cavities 222, the fuel/air mixture in each of the cavities of the cylinder blocks 154 and 156 will exhibit a pressure gradient at locations within the cavities 222 in which the inlet ports 260 of each of the sleeves 248–256 are located. Accordingly, as a piston 316–324 moves to bottom dead center; that is, a location in which the piston is located between the support shaft 280 and the second side 48 of the engine 20, so that major portions of such piston are withdrawn from the two sleeves, one in the cylinder block 154 and the other in the cylinder block 156, in which the piston is mounted to uncover the intake ports 260 formed in such sleeves, a portion of the fuel/air mixture in each cavity 222 will be forced under pressure into the sleeves forming the cylinders in which the piston is located. Thus, as each piston passes by bottom dead center, as defined above, a charge of fuel/air mixture is introduced into the region of a cylinder above the piston in the cylinder at maximum free volume of the cylinder. As the cylinder blocks 154 and 156 continue to rotate in the directions 348 and 342 respectively, increasing portions of the pistons enter the cylinders formed by the sleeves 248–256, so that the fuel/air mixture in each of the cylinders formed by the sleeves 248–256 in each of the cylinder blocks is maximally compressed as the cylinders move to a top dead center position in which the cylinders are located between the support shaft 280 and the first side 46 of the engine 20. Shortly before a pair of cylinders, one in the cylinder block 154 and one in the cylinder block 156, and the piston contained in such cylinders, passes by the top dead center position, the spark plugs 268 mounted in the spark plug bores 264 leading to such cylinders engage the conductors 90 of the spark plug contactors 86 and 124, for the first cylinder block 154 and the second cylinder block 156, respectively, and ignite the fuel/air mixtures that are in the cylinders. Accordingly, as the cylinders pass by top dead center a burning fuel/air mixture in the cylinders will begin to exert forces on the walls 264 of the two cylinders and the ends of the piston to continue the movement of the first cylinder block 154 in the direction 348 and the second cylinder block 156 in the direction 342. Accordingly, as the cylinder blocks 154 and 156 rotate about the rotation axes 44 and 50, successive pairs of cylinders, one in the first cylinder block 154 and the other in the second cylinder block 156, are brought to a position at which ignition of the fuel/air mixtures in the cylinders takes place to maintain the rotational motion of the cylinder blocks 154 and 156 in the directions 348 and 342 respectively.

As rotation of the cylinder blocks 154 and 156 continues, two cylinders, one in the cylinder block 154 and the other in the cylinder block 156, and the piston extending into such cylinders, will again approach bottom dead center so that the exhaust ports in the sleeves of the two cylinders, which is slightly above the intake ports 260 as shown in FIG. 11, will be uncovered by the piston. Accordingly, combustion products within the two cylinders will be exhausted via the exhaust tubes 272 to the exhaust rings 276 of the cylinder blocks 154 and 156 into the exhaust grooves, such as the exhaust groove 136 that surrounds the exhaust ring 276 of the cylinder block 156, and thence via the slot 130 through the wall portion 42 and the corresponding slot through the wall portion 40 into the exhaust pipes 132 and 134 for exhaust from the engine 20. The cylinders containing such piston will then receive an additional charge of fuel/air mixture as the cylinders and the piston pass by bottom dead center.

As will be seen from the above description of the operation of the engine, a higher pressure will exist in cylinders in the cylinder blocks 154 and 156 that are near top dead center than in cylinders which are near bottom dead center with the result that such pressures will have a tendency to pivot the cylinder heads toward the second side 48 of the engine 20 about an axis perpendicular to the intersection of the rotation axes 44 and 50. It has been found by experiment that such pivotation, if permitted to occur, can result in binding of pistons within the cylinder blocks of a rotary vee engine that can make the engine inoperable. Such pivotation is prevented by the inclusion in the engine 20 of the support shaft 280, the support of the ends of the support shaft 280 on the housing 24 as described above, and the support of the cylinder blocks 154 and 156 via the bearings 292–298 on the support shaft 280.

It will also be noted that the engine 20 is provided with very efficient air cooling that prevents overheating of the engine. In particular, as the cylinder blocks 154 and 156 rotate, the fins 196 on the exterior ends 160 of the cylinder blocks act as a centrifugal pump to draw air into the ends of the housing 24, via the openings 76, 78, 142 and 144 in the first end 66 of the housing 24, such openings being axially aligned with the exterior end of the cylinder block 154, and the openings 118, 120, 146 and 148 through the second end 122 of the housing 24, such openings being axially aligned with the exterior end 160 of the second cylinder block 156. The air drawn into the housing 24 is circulated among the rings 174–184 comprising portions of each of the cylinder blocks adjacent the exterior ends 160 thereof and discharged through the apertures 140 formed through the wall portions 34, 36, 40 and 42 of the housing 24.

DESCRIPTION OF FIGS. 14–16

Figure 14:
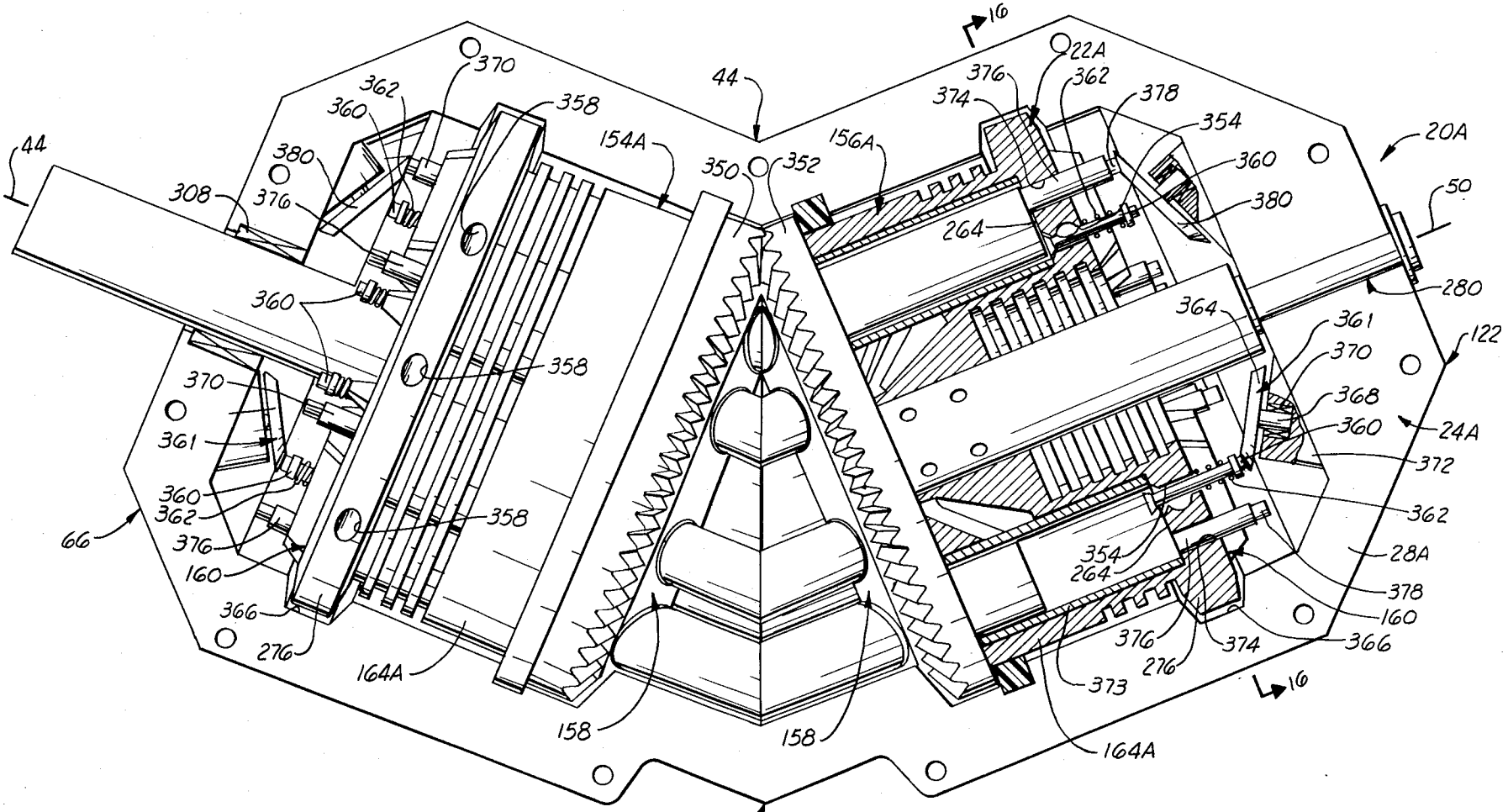
FIG. 14 is a plan view in partial cross section and partial cutaway of a second embodiment of the engine with the upper section of the housing removed.
Figure 15:
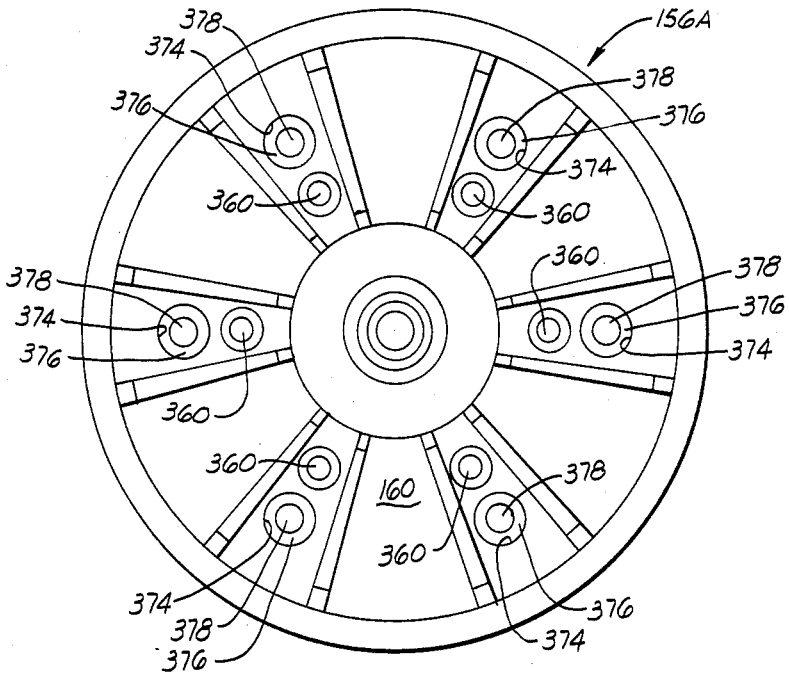
FIG. 15 is an end elevational view of one of the cylinder blocks of the engine shown in FIG. 14.
Figure 16:
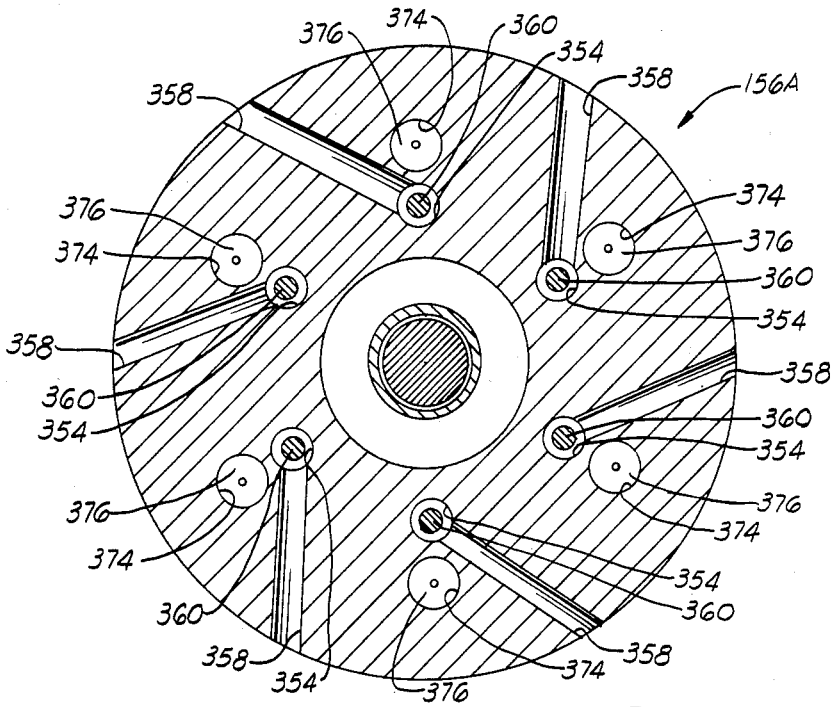
FIG. 16 is a cross section of the engine shown in FIG. 14 taken along line 16—16 of FIG. 14.

FIGS. 14–16 disclose a second embodiment of an engine, designated 20A, constructed in accordance with the present invention. Like the engine 20, the engine 20A is comprised of a housing 24A, which is made of a lower section 28A and an upper section (not shown) in the manner of the housing 24, and a cylinder block assembly 22A, mounted within the housing 24A in the same manner that the cylinder block assembly 22 is mounted in the housing 24. That is, the cylinder blocks 154A and 156A are mounted on a support shaft 280, identical to the support shaft 280 of the engine 20, and the support shaft 280 of the engine 20A is supported on the housing 24A via a support shaft bore, formed by concavities in mating surfaces of the two housing sections of which the housing 24A is comprised, and via a bearing 308 that is mounted in the drive shaft bore, again formed by concavities in mating surfaces of the two housing sections at the opposite end of the housing 24A from the support shaft bore so that the ends of the support shaft 280 are supported in the engine 20A in the same manner that the support shaft 280 is supported in the engine 20.

The cylinder blocks 154A and 156A differ from the cylinder blocks 154 and 156 in several respects. For example, FIGS. 1–13 have been drawn for the case in which each of the cylinder blocks 154 and 156 contain five cylinders and the engine 20 contains five pistons extending into one cylinder in each of the cylinder blocks 154 and 156 while FIGS. 14–16 have been drawn for the case in which the cylinder blocks 154A and 156A each include six cylinders. As will be clear to those skilled in the art, each of the cylinder blocks may contain substantially any number of cylinders depending upon the diameters of the cylinders and the diameters of the cylinder blocks.

Additionally, the engine 20A comprises a system for coordinating the rotation of the cylinder block 154A with the cylinder block 156A. In the engine 20, coordination of cylinder block rotation is effected by the extension of each piston of the engine 20 into a cylinder in each of the cylinder blocks 154A and 156A and such mode of coordination will result in side stresses being exerted on the pistons of the engine 20. In the engine 20A, a beveled gear ring 350 is mounted on the first cylinder block 154A to extend about the interior end thereof and a gear ring 352 is similarly mounted on the cylinder block 156A to extend about the interior end 158 of the cylinder block 156A. The gear rings 350 and 352 are angularly positioned on the cylinder blocks 154A and 156A so that the teeth of the gear ring 350 will mesh with the teeth of the gear ring 352 to coordinate the rotational movement of the cylinder blocks 154A and 156A about the rotation axes 44 and 50.

The engine 20A also utilizes a different mode of exhausting combustion products from the cylinders formed in the cylinder blocks 154A and 156A as shown for the cylinder block 156A. In particular, a plurality of exhaust bores 354 are formed axially through portions of the cylinder block 156A to intersect the end walls 264 of each of the cylinders and the exterior end 160 of the cylinder block 156A. The exhaust rings 276 are displaced from the position of such rings in the engine 20 to the exterior ends 160 of the cylinder blocks 154A and 156A and exhaust passages 358 are formed through portions of the cylinder blocks between each of the exhaust bores 354 and the peripheries of the exhaust rings 276. A conventional poppet valve 360 is mounted in each of the bores 354 and the valves 360 are biased outwardly of the exterior ends 160 of the cylinder block 156A via springs 362 so that a seat (not numerically designated in the drawings) formed on the inner end of each valve 360 will normally close communication between each cylinder and the exhaust passage 358 associated therewith in a conventional manner but will enable communication between the cylinder and its associated exhaust passage in response to a movement of the valve 360 toward the interior end of the cylinder block 156A. Similar exhaust bores, exhaust passages and poppet valves are provided for the cylinder block 154A. Concomittantly with the shift of the exhaust rings to the exterior ends of the cylinder blocks, the exhaust grooves are displaced toward the ends of the housing from the position such grooves occupy in the engine 20.

As shown in FIGS. 15 and 16, for the cylinder block 156A, the valves 360 are equidistant from the rotation axes of the cylinder blocks and, as shown in FIG. 14, wheels 361 are mounted within each end of the lower case section 28A and displaced from the support shaft 280 in a direction toward the second side 48 of the engine 20A a distance such that a beveled periphery 364 of each wheel 361 will engage each valve 360 as the valve nears bottom dead center of the engine 20A and force the valve 360 toward the interior end of the cylinder block 156A to provide communication between the cylinder associated with the valve and the exhaust passage 358 leading from the exhaust bore 354 in which the valve is mounted. Thus, as each cylinder approaches bottom dead center, one of the wheels 361 engages the valve mounted in the cylinder to exhaust reaction products from the cylinder to one of the exhaust grooves, formed by semi-circular grooves 366 in the lower case section 28A of the housing 24A and similar grooves in the upper case section (not shown) of the engine 20A, for discharge of the products from the engine 20A via exhaust pipes that are mounted on the upper case section (not shown) in the same manner that exhaust pipes 132 and 134 are mounted on the upper case section 26 of the engine 20. The wheels 361 are rotatably mounted on the lower case section 28A to minimize mechanical shock to the valves 360 as shown for the wheel 361 adjacent the end 122 of the engine 20A. Specifically, such wheel has a shaft 368 that is mounted in a bearing 370 in a projection 372 formed on the inside of the lower case section 28A.

As in the case of the engine 20, cylinders are formed in the cylinder blocks 154A and 156A of the engine 20A via sleeves, one of which has been designated 373 in FIG. 14, that are mounted in bores that extend into the cylinder blocks 154A and 156A, from the interior ends thereof, parallel to the rotation axes 44 and 50. The cylinder forming sleeves in the engine 20A differ from the sleeves 248–256 of the engine 20 in that the exhaust tubes 272 found in the sleeves 248–256 are deleted in the engine 20A.

It is also contemplated that either engine 20 or 20A can be operated in the manner of a diesel engine and the diesel configuration has been illustrated for the engine 20A. In particular, and as shown for the cylinder block 156A, a plurality of injector bores 374 are formed through portions of the cylinder blocks 154A and 156A between each of the cylinders formed therein and the exterior ends 160 of the cylinder blocks. Fuel is injected into the cylinders via a mechanical fuel injector 376 mounted in each of the injector bores 374. As can be seen in FIGS. 15 and 16, for the cylinder block 156A, the injectors 376 are positioned equidistantly from the rotation axes 44 and 50 to extend in a ring about the rotation axes. The fuel injectors are of the conventional type having a plunger 378 at one end for operation by depression of the plunger to eject a small quantity of fuel from the other end of the injector and the injectors 376 are mounted in the cylinder block 156A so that the plungers 378 face outwardly from the exterior ends 160 of the cylinder blocks to be depressed by wheels 380 that are mounted within the lower case section 28A, at the ends 66 and 122 thereof, in positions displaced toward the first side 44 of the engine 20A from the rotation axes 44, 50 so that fuel injection will occur near the top dead center position of each of the cylinders. As shown for the wheel 380 adjacent the housing end 66, the wheels 380 are rotatably mounted in the same manner and for the same purpose as the wheels 362. (As in the case of the spark plug contactors 86 and 124 of the engine 20, the wheels 380 of the engine 20A can be mounted on pivoting members for ignition advancement.) Fuel can be supplied to the fuel injectors 376 via ports (not shown) that are formed through the cylinder blocks to conventional rotating seals (not shown) that can be mounted on the base portions 164A of the cylinder blocks.

The operation of the engine 20A is substantially the same as the operation of the engine 20 excepting only the manner in which exhaust of combustion products is carried out from the cylinders of the cylinder blocks 154A and 156A via the valves 360 and except for the manner in which fuel is injected into the cylinders of the cylinder blocks 154A and 156A and ignited. In the engine 20A, only air is drawn into the intake pipe (not shown for the engine 20A) and compressed in the cylinders of the cylinder blocks 154A and 156A for adiabatic heating of the air in the cylinders. Fuel is then injected into the cylinders via the injectors 374 and is ignited by the high temperature of air in the cylinders that has resulted from the compression of air in the cylinders of the cylinder blocks 154A and 156A.

It will be clear that the present invention is well adapted to carry out the objects and attain the ends and advantages mentioned as well as those inherent therein. While presently preferred embodiments of the invention have been described for purposes of this disclosure, numerous changes may be made which will readily suggest themselves to those skilled in the art and which are encompassed within the spirit of the invention disclosed and as defined in the appended claims.

What is claimed is:

1. In an internal combustion engine of a type comprising:

a housing;

two cylinder blocks mounted in the housing for rotation of one cylinder block about a first rotation axis and rotation of the other cylinder block about a second rotation axis angled with respect to the first rotation axis so that the rotation axes are angled toward one side of the engine, each cylinder block having a plurality of cylinders formed therein to intersect the end of the cylinder block adjacent the other cylinder block and to extend therefrom into the cylinder block parallel to the rotation axis of the cylinder block; and a plurality of angled pistons, each piston having a portion disposed in a cylinder of one cylinder block and a portion disposed in a cylinder in the other cylinder block for orbital motion of the pistons coordinately with rotation of the cylinder blocks;

the improvement wherein a central bore is formed through each of the cylinder blocks to extend along the rotation axis for the cylinder block; and wherein the engine further comprises:

an angled support shaft having end portions extended axially outwardly of the cylinders of the cylinder blocks and supported by the housing and having a portion extending through each cylinder block along the rotation axis of the cylinder block; and bearing means for rotatably and axially supporting each of the cylinder blocks on said portions of the support shaft.

2. The internal combustion engine of claim 1 wherein a drive shaft bore is formed through the housing about the first rotation axis; wherein a support shaft support bore is formed through the housing about the second rotation axis; wherein said one cylinder block comprises a tubular drive shaft extending symmetrically about the first rotation axis to extend through said drive shaft bore; wherein said other cylinder block comprises a tubular idler shaft extending symmetrically about the second rotation axis; wherein the bearing means comprises:

a first pair of spaced apart bearings mounted on the portion of the support shaft extending along the first rotation axis, the drive shaft being mounted on said first pair of bearings mounted on the support shaft; and a second pair of spaced apart bearings mounted on the portion of the support shaft extending along the second rotation axis, the idler shaft being mounted on said second pair of bearings mounted on the support shaft;

wherein a portion of the support shaft is extended into the support shaft bore for supporting one end of the support shaft on the housing; and wherein the engine further comprises a support bearing mounted in the drive shaft bore to receive the drive shaft and thereby support the other end of the support shaft on the housing.

3. The engine of claim 1 wherein each of the cylinder blocks is characterized as having an interior end substantially facing the interior end of the other cylinder and an exterior end facing substantially away from the cylinder block; wherein a cavity centered on the support is formed in each cylinder block to intersect the interior of the cylinder block to provide fluid communication between the interiors of the cylinder blocks and the interior of central portions of the housing; wherein the cavity in each cylinder block is in fluid communication with each of the cylinders of the cylinder block near the interior end of the cylinder block; and wherein the engine comprises an air intake pipe opening into said central portions of the housing.

4. The engine of claim 3 wherein the cylinders of each cylinder block are disposed in a ring, centered on the support shaft, about the cavity in the block; and wherein the engine is further characterized as comprising means formed on the interior walls of each cavity for imparting rotational motion of the cylinder block wherein the cavity is formed to air in the cavity.

5. The engine of claim 4 wherein the means for imparting rotation motion to air in the cavities is comprised of a plurality of fins formed on radially innermost surfaces of the cavity walls and a plurality of slots formed in radially outermost surfaces of the cavity walls.

6. The engine of claim 4 wherein each cylinder block is characterized as having a flat surface formed on the interior end thereof to extend about the support shaft perpendicularly to the rotation axis of the cylinder block; wherein each cavity intersects central portions of the flat surface on the interior end of the cylinder block in which the cavity is formed; wherein the engine further comprises a supercharging block mounted on central portions of the support shaft and nested within the pistons, the supercharging block having opposite, flat ends juxtaposed to the flat surfaces of the interior ends of the cylinder blocks to converge toward the side of the engine toward which said rotation axes are angled and the supercharging block having an outer periphery comprised of two intersecting, substantially cylindrical surfaces in close proximity to central portions of the pistons; wherein the housing is characterized as having a portion extending about central portions of the pistons in close proximity to the pistons, whereby the supercharging block, the housing walls and portions of the interior ends of the cylinder blocks form an annular chamber, decreasing in length from the side of the engine from which the rotation axes are angled to the side of the engine toward which the rotation axes are angled, in which the pistons orbit the support shaft; and wherein a notch is formed in the side of the supercharging block toward which the ends thereof converge to provide fluid communication from said annular chamber to the cavities in the cylinder blocks.

7. The engine of claim 6 wherein a beveled surface is formed on the interior end of each cylinder block to extend coaxially about the flat surface on the interior end of the cylinder block; and wherein the cylinder blocks are axially positioned on the support shaft to juxtapose the beveled surface on one cylinder block to the beveled surface of the other cylinder block at the side of the engine toward which the rotation axes are angled.

8. The engine of claim 3 wherein the cylinders of each cylinder block are disposed in a ring, centered on the support shaft, about the cavity in the block; wherein each cylinder block is characterized as having a flat surface formed on the interior end thereof to extend about the support shaft perpendicularly to the rotation axis of the cylinder block; wherein each cavity intersects central portions of the flat surface on the interior end of the cylinder block in which the cavity is formed; wherein the engine further comprises a supercharging block mounted on central portions of the support shaft and nested within the pistons, the supercharging block having opposite, flat ends juxtaposed to the flat surfaces of the interior ends of the cylinder blocks to converge toward the side of the engine toward which said rotation axes are angled and the supercharging block having an outer periphery comprised of two intersecting, substantially cylindrical surfaces in close proximity to central portions of the pistons; wherein the housing is characterized as having a portion extending about central portions of the pistons in close proximity to the pistons, whereby the supercharging block, the housing walls and portions of the interior ends of the cylinder blocks form an annular chamber, decreasing in length from the side of the engine from which the rotation axes are angled to the side of the engine toward which the rotation axes are angled, in which the pistons orbit the support shaft; and wherein a notch is formed in the side of the supercharging block toward which the ends thereof converge to provide fluid communication from said annular chamber to the cavities in the cylinder blocks.

9. The engine of claim 8 wherein a beveled surface is formed on the interior end of each cylinder block to extend coaxially about the flat surface on the interior end of the cylinder block; and wherein the cylinder blocks are axially positioned on the support shaft to juxtapose the beveled surface on one cylinder block to the beveled surface of the other cylinder block at the side of the engine toward which the rotation axes are angled.

10. The engine of claim 8 further comprising two ring gears, each ring gear mounted on one of the cylinder blocks to extend in a circle about the interior end thereof, the teeth on one ring gear meshing with the teeth on the other ring gear to coordinate rotation of the two cylinder blocks.

11. The engine of claim 4 further comprising two ring gears, each ring gear mounted on one of the cylinder blocks to extend in a circle about the interior end thereof, the teeth on one ring gear meshing with the teeth on the other ring gear to coordinate rotation of the two cylinder blocks.

12. The engine of claim 11 wherein openings are formed through the housing about the rotation axes of the cylinder blocks axially of the cylinder blocks; wherein each cylinder block is comprised of a plurality of spaced rings extending in a series from the exterior end of the cylinder block, the cylinder blocks having axially extending portions passing through said rings in which cylinders of the cylinder blocks are formed; and wherein a plurality of apertures are formed through the housing radially outwardly, with respect to the rotation axes, of the series of rings of which each cylinder block is comprised.

13. The engine of claim 1 wherein each of the cylinder blocks is characterized as having an interior end substantially facing the interior end of the other cylinder block and an exterior end facing substantially away from the other cylinder block; and wherein the engine further comprises two ring gears, each ring gear mounted on one of the cylinder blocks to extend in a circle about the interior end thereof, the teeth on one ring gear meshing with the teeth on the other ring gear to coordinate rotation of the two cylinder blocks.

14. The engine of claim 13 wherein openings are formed through the housing about the rotation axes of the cylinder blocks axially of the cylinder blocks;

wherein each cylinder block is comprised of a plurality of spaced rings extending in a series from the exterior end of the cylinder block, the cylinder blocks having axially extending portions passing through said rings in which cylinders of the cylinder blocks are formed; and wherein a plurality of apertures are formed through the housing radially outwardly, with respect to the rotation axes, of the series of rings of which each cylinder block is comprised.

15. The engine of claim 1 wherein each cylinder block is characterized as having an interior end adjacent the interior end of the other cylinder block and an opposite exterior end; wherein the cylinders in each cylinder block are arranged in a ring centered on the cylinder block rotation axis with each cylinder extending parallel to the cylinder block rotation axis; wherein a plurality of fuel injection bores are formed through each cylinder block, each fuel injection bore intersecting the exterior end of the cylinder block in which the fuel injection bore is formed and intersecting the wall of one of the cylinders in the cylinder block and the fuel injection bores arranged equidistantly in a circle about the rotation axis of the cylinder block in which the fuel injection bores are formed; and wherein the engine further comprises:

a mechanically actuated fuel injector mounted in each of the fuel injection bores; and means, mounted on the housing, for actuating each fuel injector as the fuel injector passes by a pre-selected angular position on the housing at the side of the housing toward which the rotation axes are angled.

16. The engine of claim 15 wherein a plurality of exhaust bores are formed through each cylinder block, each exhaust bore intersecting the exterior end of the cylinder block and the wall of one of the cylinders of the cylinder block; wherein an exhaust port is formed in each cylinder block from each exhaust bore to the outer periphery of the cylinder block for releasing combustion products from the cylinders; and wherein the engine further comprises:

a valve mounted in each exhaust bore for providing fluid communication between the cylinder and exhaust port associated with the exhaust bore in response to movement of the valve toward the interior end of the cylinder block;

means for biasing each valve away from the interior end of the cylinder block in which the valve is mounted; and means, mounted on the housing, for momentarily forcing each valve toward the interior end of the cylinder block in which the valve is mounted as the valve passes by a pre-selected angular position on the housing at the side of the housing away from which the rotation axes are angled.

17. In an internal combustion engine of a type comprising:

a housing;

two cylinder blocks mounted in the housing for rotation of one cylinder block about a first rotation axis and rotation of the other cylinder block about a second rotation axis angled with respect to the first rotation axis so that the rotation axes are angled toward one side of the engine, each cylinder block having a plurality of cylinders formed therein to intersect the end of the cylinder block adjacent the other cylinder block and to extend therefrom into the cylinder block parallel to the rotation axis of the cylinder block; and a plurality of angled pistons, each piston having a portion disposed in a cylinder of one cylinder block and a portion disposed in a cylinder in the other cylinder block for orbital motion of the pistons coordinate with rotation of the cylinder blocks;

the improvement wherein a cavity is formed in the interior of each cylinder block to extend about the rotation axis of the cylinder block and to intersect the end of the cylinder block adjacent the other cylinder block; wherein means for imparting rotational movement of the cylinder blocks to air within the cavities are formed on the interior walls of the cavities; and wherein the housing is characterized as having an air intake opening into portions of the housing between adjacent ends of the cylinder blocks.

18. In an internal combustion engine of a type comprising:

a housing;

two cylinder blocks mounted in the housing for rotation of one cylinder block about a first rotation axis and rotation of the other cylinder block about a second rotation axis angled with respect to the first rotation axis so that the rotation axes are angled toward one side of the engine, each cylinder block having a plurality of cylinders formed therein to intersect the end of the cylinder block adjacent the other cylinder block and to extend therefrom into the cylinder block parallel to the rotation axis of the cylinder block; and a plurality of angled pistons, each piston having a portion disposed in a cylinder of one cylinder block and a portion disposed in a cylinder in the other cylinder block for orbital motion of the pistons coordinate with rotation of the cylinder blocks;

the improvement wherein openings are formed in opposite ends of the housing axially of the cylinder blocks; wherein each cylinder block is comprised of a plurality of spaced rings extending in a series about the cylinder block rotation axis adjacent the ends of the housing, the cylinder blocks having axially extending portions passing through said rings in which cylinders in the cylinder blocks are formed; and wherein a plurality of apertures are formed through the housing radially outwardly, with respect to the rotation axes, of the series of rings of which each cylinder block is comprised.

* * * * *

UNITED STATES PATENT AND TRADEMARK OFFICE

CERTIFICATE OF CORRECTION

PATENT NO. : 4,648,358

DATED : March 10, 1987

INVENTOR(S) : Robert W. Sullivan, et al.

It is certified that error appears in the above-identified patent and that said Letters Patent is hereby corrected as shown below:

Column 5, line 51, please delete the numeral "106" and substitute therefor the numeral "102".

Column 8, line 29, please insert the word --between-- after the numeral "228" and before the word "each".

Column 20, line 68, please insert the word --shaft-- between the words "port" and "is".

Column 21, line 1, please insert the word --end-- between the words "interior" and "of".

Signed and Sealed this

Twenty-ninth Day of September, 1987

*Attest:*

DONALD J. QUIGG

*Attesting Officer* *Commissioner of Patents and Trademarks*